US006756734B2

(12) United States Patent
Tsuida et al.

(10) Patent No.: US 6,756,734 B2
(45) Date of Patent: Jun. 29, 2004

(54) ELECTRON TUBE DEVICE MOUNTED WITH A COLD CATHODE AND A METHOD OF IMPRESSING VOLTAGES ON ELECTRODES OF THE ELECTRON TUBE DEVICE

(75) Inventors: Shunji Tsuida, Tokyo (JP); Hironori Imura, Tokyo (JP); Hideo Makishima, Tokyo (JP)

(73) Assignee: NEC Microwave Tube, Ltd., Kanagawa-Ken (JP)

( * ) Notice: Subject to any disclaimer, the term of this patent is extended or adjusted under 35 U.S.C. 154(b) by 372 days.

(21) Appl. No.: 09/960,767

(22) Filed: Sep. 24, 2001

(65) Prior Publication Data

US 2002/0036470 A1 Mar. 28, 2002

Related U.S. Application Data

(62) Division of application No. 09/808,041, filed on Mar. 15, 2001, now Pat. No. 6,583,567, which is a division of application No. 09/132,571, filed on Aug. 12, 1998, now Pat. No. 6,310,438.

(30) Foreign Application Priority Data

Aug. 12, 1997 (JP) ..... 9-217666

(51) Int. Cl.[7] ..... H01J 23/16

(52) U.S. Cl. ..... 315/3; 315/5.37; 315/15; 313/310; 313/351

(58) Field of Search ..... 315/3, 3.5, 5.33, 315/5.38, 39.3, 15, 5.37; 313/309, 310, 351, 495

(56) References Cited

U.S. PATENT DOCUMENTS

| | | | | | |
|---|---|---|---|---|---|
| 5,124,664 | A | | 6/1992 | Cade et al. | 313/309 |
| 5,680,011 | A | | 10/1997 | Makishima | 315/3 |
| 5,723,867 | A | | 3/1998 | Imura | 313/309 |
| 5,929,557 | A | | 7/1999 | Makishima et al. | 313/309 |
| 5,986,388 | A | | 11/1999 | Makishima | 313/309 |
| 6,114,808 | A | * | 9/2000 | Takahashi | 315/3.5 |
| 6,310,438 | B1 | * | 10/2001 | Tsuida et al. | 315/3.5 |
| 6,377,231 | B2 | * | 4/2002 | Seko et al. | 345/13 |
| 6,583,567 | B2 | * | 6/2003 | Tsuida et al. | 315/3.5 |

FOREIGN PATENT DOCUMENTS

| | | |
|---|---|---|
| JP | 62-94547 | 6/1987 |
| JP | 63-939 | 1/1988 |
| JP | 63-245178 | 10/1988 |
| JP | 2-137745 | 11/1990 |
| JP | 7-192638 | 7/1995 |
| JP | 9-63489 | 3/1997 |

* cited by examiner

*Primary Examiner*—Haissa Philogene
(74) *Attorney, Agent, or Firm*—Sughrue Mion, PLLC

(57) ABSTRACT

Expressing a perveance of an electron gun to be determined by a form of the electron gun as $P\mu$, a voltage to be impressed on an accelerating electrode Va and a beam current Ib, voltage Va which satisfies the following expression, $$Ib < P\mu \times Va^{3/2}$$

is impressed on the accelerating electrode.

Further, the electric potential of the accelerating electrode is maintained at the highest level of all electrodes in the electron tube at all times.

4 Claims, 16 Drawing Sheets

ELECTRON TUBE DEVICE MOUNTED WITH A COLD CATHODE AND A METHOD OF IMPRESSING VOLTAGES ON ELECTRODES OF THE ELECTRON TUBE DEVICE

This is a divisional of application Ser. No. 09/808,041 (Confirmation No. Unknown) filed Mar. 15, 2001, now U.S. Pat. No. 6,583,567, which is a Divisional Application of Ser. No. 09/132,571 now allowed filed Aug. 12, 1998, now U.S. Pat. No. 6,310,438, the disclosure of which is incorporated herein by reference.

BACKGROUND OF THE INVENTION

1. Field of the Invention

The present invention relates to an electron tube device, more particularly to an electron tube device mounted with a cold cathode having an electron gun which uses a cold cathode provided with an array of field emitters as an election source, and a method of impressing voltages on electrodes of the electron tube device.

2. Description of the Related Art

Collision of positive ions with a cold cathode is one of the reasons for degradation of the cold cathode of an electron tube which uses a cold cathode as an electron source. Positive ions are generated when beam collide with an electrode such as a collector electrode or an accelerating electrode having electric potential higher than that of the emitters or the residual gas in an electron tube. Since generated positive ions tend to proceed in the direction of lower electric potential, some of the ions proceed toward the cold cathode. When these positive ions collide with a cold cathode emitter, the emitter is deformed. The beam current from the cold cathode is highly sensitive to deformation of the shape of the emitter and easily changed by its influence. The degradation of characteristics of a cold cathode caused by collision of positive ions is remarkably larger than in a hot cathode. Therefore, in an electron tube having a cold cathode as an electron source, degradation of characteristics proceeds rapidly.

In order to prevent the degradation characteristic in a cold cathode, for example, as disclosed in Japanese Patent Laid-open No. 63489/97, an electron tube mounted with a cold cathode of this kind has hitherto been provided with a mechanism which prevents the degradation of the cold cathode caused by collision against the cold cathode by positive ions generated on the collector electrode side.

FIGS. 1A and 1B show an example of a structure of an electron tube mounted with a cold cathode disclosed in Japanese Patent Laid-open No. 63489/97. Around cold cathode 11 or emitting electron beam e, there is provided Wehnelt electrode 12, with accelerating electrode 13, ion trap electrode 14 and collector electrode 15 also provided. In cold cathode 11, for example, a part of which is shown in an enlarged view in FIG. 1B, a number of needle-shaped emitters 22 are regularly disposed on the surface of silicon substrate 21, and gate electrodes 24 are disposed each having gate hole 23 which is disposed in front of and near the top of the emitter 22 corresponding to each emitter. Gate electrode 24 is composed of a metallic thin film and disposed on substrate 21 through insulation layer 25. When the electron tube is operated, as shown in FIG. 1A, a control voltage in a range of 0±several volts is applied from gate power supply 31 to gate electrode 24 against cold cathode 11. Further, a negative voltage of several hundred V is given to Wehnelt electrode 12 from Wehnelt power supply 32, and a positive accelerating voltage of several kV is impressed on accelerating electrode 13 from power supply 33. Further, a negative voltage of several hundred V against collector electrode 15 is applied from power supply 35 to ion trap electrode 14.

The operation of the electron tube device mounted with the cold cathode will next be described. By controlling gate electrode 24 to the proper electric potential, electrons are emitted from the top of each emitter 22 and radiated in the direction of collector electrode 15 passing through each corresponding gate hole 23 with the acceleration potential generated by accelerating electrode 13. At this time, positive ions generated in collector electrode 15 have a tendency to proceed in the direction of a cathode of low electric potential (direction of ion trap electrode 14). However, since the electric potential of accelerating electrode 13 is sufficiently high, positive ions are repelled by means of the electric potential of the accelerating electrode 13 and acquired by ion trap electrode 14. Therefore, positive ions can hardly reach cold cathode 11 and hence deterioration of the cold cathode can be prevented.

Further, in Japanese Patent Laid-open No. 192638/95, there are disclosed conditions that prevent deterioration of a cathode caused by the collision of positive ions against the cathode in a traveling wave tube device which is one of electron tube devices mounted with cold cathodes, the positive ions being generated in a slow wave circuit or the collector electrode side of the traveling wave tube device.

FIG. 2 shows an example of a structure of the traveling wave tube disclosed in Japanese Patent Laid-open No. 192638/95. A traveling wave tube is an electron tube which amplifies a microwave by utilizing the interaction between the electron beam (e) and the microwave, and has slow wave circuit 2 which makes the electron beam and the microwave interact between an electron gun and a collector electrode (not shown). The electron gun includes cathode 10, Wehnelt electrode 12, accelerating electrode 13 and ion barrier electrode 16. If a beam current is denoted as Io (A), a beam radius ro (m), the inside diameter of ion barrier electrode 16 rib (m), electric potential of slow wave circuit 2 Vo (V), the inside diameter rib and the electric potential Vib of ion barrier electrode 16 are determined so that they can satisfy the following relationship.

$$Vo < Vib - \frac{aI0}{\sqrt{Vib}}\left[2\log\frac{rib}{ro} + 1\right]$$

$$\alpha = 1.515\times10^4\ (V^{3/2}/A)$$

According to the present invention, the ion barrier electrode can prevent ions from reaching the cathode by always forming a surface of high electric potential which can prevent the generation of positive ions to caused in a slow wave circuit or the collector electrode side, that is, a barrier. The patent has no description with reference to a cold cathode, but it is also applicable to a traveling wave tube mounted with a cold cathode.

In this way, a mechanism is proposed which can prevent the deterioration of the characteristics of a cathode caused by collision of a cathode with positive ions generated in a collector electrode or a slow wave circuit other than an electron gun.

In an electron gun using a hot cathode as an electron source, the maximum emission current to be obtained from the electron gun is determined by the Langmuir-Child law. In other words, according to the Langmuir-Child law, the maximum emission current is determined by the product of a coefficient inevitably determined by the electron gun structure (hereinafter called a perveance) and 3/2 power of the accelerating electrode voltage.

On the other hand, in the electron gun using a cold cathode as the electron source, the emission current is necessarily determined by the gate electrode impressed voltage and does not satisfy the above Langmuir-Child law. Consequently, when a cold cathode is used as the electron source, a beam current in excess of the product of an electron gun perveance determined by the structure of the electron gun and 3/2 power of the accelerating electrode voltage can be removed from the cathode.

In this case, when the beam current emits electrons from the cathode under an operating condition exceeding the operating conditions of a space charge restriction region indicated by the product of the perveance of the electron gun and 3/2 power of the accelerating electrode voltage, there is a problem that electric charges in express of the electric charges allowed by the electron gun structure will exist in the space in the vicinity of the cathode. Particularly, an array of cold cathodes composed of two or more emitters form a domain where electron density becomes high within the region in which electrons emitted from neighboring emitters interact. That is, in a cold cathode composed of a single emitter, the beam current receives only space charge restrictions formed in the extreme vicinity of the emitter surface. Electrons which override the space charge restrictions in the vicinity of the emitter surface fly under the control of the electron lens system. On the other hand, in the cold cathode comprising an array of field emitters which can supply a large current, electrons overriding the space charge restrictions in the vicinity of said emitter surface are next subject to space charge restrictions from electrons emitted from the neighboring emitter, being accordingly subjected to restrictions related to lateral divergence. Therefore, when the electron beams are considered as a whole, charges are accumulated in the region in which electrons emitted from neighboring emitters on the cathode surface interact, then beam transmission is rapidly deteriorated from the effects by the electric field formed by these excessive charges, that is, the electron beam diverges. At this time, motion energy of the electron is almost 0 eV for the hot cathode, but is about several tens eV for the cold cathode because electrons are accelerated by the gate electrode impressed voltage. A part of these dispersed electrons become uncontrollable and collide with the accelerating electrode and a helix disposed to it in the traveling wave tube. When electrons collide with the accelerating electrode, positive ions or gas are generated from the accelerating electrode. When the beam strikes the gas generated from the accelerating electrode, positive ions are generated. These positive ions collide with the cold cathode and cause deformation of the emitter. In this way, in the prior art electron tube device mounted with the cold cathode, the emission characteristics of the cold cathode are deteriorated.

In the prior art, there has been a method for preventing positive ions generated by the collector from colliding with the cathode by providing an ion barrier electrode. However, since there has been no definite limitation in the relationship between the beam current and the accelerating electrode voltage, no applicable means has been presented for preventing positive ions from being generated between the cathode and the accelerating electrode, and hence design procedures for a constantly stable action have never been realized.

SUMMARY OF THE INVENTION

An object of the present invention is to provide an electron tube device mounted with a cold cathode having a traveling wave tube device, the device being protected against deterioration of the cold cathode caused by the collision of positive ions against the cold cathode, and a method of impressing voltages on electrodes of the election tube device.

In order to achieve the above object, a first method of impressing voltages on electrodes of an electron tube device mounted with a cold cathode of the present invention comprises the steps of:

impressing voltage Va which satisfies the following expression on an accelerating electrode, $$Ib<P\mu\times Va^{3/2}$$

when a beam current emitted from the cold cathode by impressing voltage on a gate electrode is denoted as Ib, and a perveance of an electron gun to be determined according to a form of said electron gun is denoted as $P\mu$; and impressing required voltages on a cold cathode having an array of field emitters, a gate electrode and a collector electrode, respectively.

In the electron tube device mounted with the cold cathode, in accordance with the above electrode voltage impressing method, since the beam current is less than a product of a perveance of the electron gun and the 3/2 power of the accelerating electrode voltage, the divergence of the beam due to space charge effects is controlled and hence the beam scarcely collides with the accelerating electrode. Accordingly, positive ions are generated between the cold cathode and the accelerating electrode thereby preventing the deterioration of the cold cathode.

A second method of impressing voltages on electrodes of the electron tube device mounted with the cold cathode of the present invention is a method of impressing voltages on electrodes of a traveling wave tube device comprising the steps of:

impressing voltage Va which satisfies the following expression on an accelerating electrode, $$Ib<P\mu\times Va^{3/2}$$

when the beam current emitted from the cold cathode by impressing voltage on the gate electrode is denoted as Ib, and the perveance of the electron gun to be determined according to the form of said electron gun is denoted as $P\mu$; and impressing required voltages on a cold cathode having an array of field emitters, a gate electrode, a Wehnelt electrode, an ion trap electrode, a slow wave circuit and a collector electrode, respectively.

According to the voltage impressing condition which satisfies expression 1, since electrons emitted from the cold cathode reach the collector electrode through the slow wave circuit without colliding with the accelerating electrode and the ion trap electrode, the cold cathode is protected against impulse damage which is caused by positive ions, thereby enabling it to operate stably enabling it.

A third method of impressing voltages on electrodes of the electron tube device mounted with the cold cathode of the present invention comprises the step of:

impressing required voltages on a cold cathode having an array of field emitters, a Wehnelt electrode, a gate electrode, an accelerating electrode and a collector electrode, respectively, and maintaining the difference between the electric potential of the Wehnelt electrode and that of the gate electrode to a constant value.

A fourth method of impressing voltages on electrodes of the electron tube device mounted with the cold cathode of the present invention is the method of impressing voltages on electrodes of a traveling wave tube device comprising the step of:

impressing required voltages on a cold cathode having an array of field emitters, a gate electrode, a Wehnelt electrode, an accelerating electrode, an ion trap electrode, a slow wave circuit and a collector electrode, respectively, and concurrently maintaining the difference between the electric potential of the Wehnelt electrode and that of the gate electrode at a constant value.

According to the third and the fourth methods of impressing voltages on electrodes of the electron tube device mounted with the cold cathode of the present invention, since the difference between the electric potential of the Wehnelt electrode and that of the gate electrode is kept constant, generation of gas or positive ions caused by collision of the beam current against the accelerating electrode can be prevented thereby realizing safe operation of the device.

A fifth method of impressing voltages on electrodes of the electron tube device mounted with the cold cathode of the present invention comprises the step of:

impressing required voltages on a cold cathode having an array of field emitters, a gate electrode and a collector electrode, respectively, and impressing on an accelerating electrode the highest voltage of said respective electrodes at all times including the operation time, the rise time, the fall time and the time of abnormal operation of the device.

A sixth method of impressing voltages on electrodes of the electron tube device mounted with the cold cathode of the present invention comprises the steps of:

impressing a required voltage on an accelerating electrode;

impressing required voltages on a cold cathode having an array of field emitters, a gate electrode, an electrode adjacent to the accelerating electrode and a collector electrode, respectively, and concurrently impressing on an electrode included in the above electrodes and disposed adjacent to the accelerating electrode the highest voltage of said respective electrodes at all times including the operation time, the rise time, the fall time and the time of abnormal operation of the device.

A seventh method of impressing voltages on electrodes of the electron tube device mounted with the cold cathode of the present invention is the method of impressing voltages on electrodes of the traveling wave tube device comprising the step of:

impressing required voltages on a cold cathode having an array of field emitters, a gate electrode, a Wehnelt electrode, an ion trap electrode, a slow wave circuit and a collector electrode, respectively, and impressing on an accelerating electrode the highest voltage of the respective electrodes at all times including the operation time, the rise time, the fall time and the time of abnormal operation of the device.

In the fifth, sixth and the seventh methods of impressing voltages on the electrodes of the electron tube device mounted with the cold cathode of the present invention, since the accelerating electrode or the electrode adjacent to the accelerating electrode always has the highest electric potential, even when an abnormality occurs in the electron source, generated positive ions can not reach the cathode because they are repelled by the electric field produced by the electrode of the highest electric potential.

An eighth method of impressing voltages on electrodes of the electron tube device mounted with the cold cathode of the present invention comprises the step of:

impressing required voltages on a cold cathode having an array of field emitters, a gate electrode, an accelerating electrode and a collector electrode, respectively, and finally impressing the gate electrode voltage at the rise time of the device and first shutting off the gate electrode voltage at the fall time of the device.

A ninth method of impressing voltages on electrodes of the electron tube device mounted with the cold cathode of the present invention is the method of impressing voltages on electrodes of the traveling wave tube device comprising the steps of:

impressing required voltages on a cold cathode having an array of field emitters, a gate electrode, an accelerating electrode, a Wehnelt electrode, an ion trap electrode, a slow wave circuit and a collector electrode, respectively, and finally impressing the gate electrode voltage at the rise time of the device and first shutting off the gate electrode voltage at the fall time of the device.

In the eighth and the ninth methods of impressing voltages on the electrodes of the electron tube device mounted with the cold cathode of the present invention, when the electron beam is emitted, since prescribed voltages are impressed on electrodes other than the collector electrode, generation of gas or positive ions caused by the collision of electron beams against electrodes other than the collector electrode can be prevented, thereby controlling deterioration of the cold cathode.

A first electron tube device mounted with a cold cathode of the present invention comprises:

an electron gun having a cold cathode for emitting electron beam from an array of field emitters, a gate electrode and an accelerating electrode;

a collector electrode; and a power supply unit for impressing required voltages on the cold cathode, gate electrode, and collector electrode, respectively, and impressing voltage Va which satisfies the following expression on the accelerating electrode, $$Ib < P\mu \times Va^{3/2}$$

when a beam current emitted from the cold cathode by impressing voltages on gate electrode is denoted as Ib, and a perveance of an electron gun to be determined according to the form of said electron gun is denoted as $P\mu$.

A second electron tube device mounted with a cold cathode of the present invention is a traveling wave tube device comprising:

an electron gun having a cold cathode for emitting electron beam from an array of field emitters, a gate electrode, a Wehnelt electrode, an accelerating electrode and an ion trap electrode;

a slow wave circuit;

a collector electrode;

a power supply unit for impressing required voltages on the cold cathode, gate electrode, Wehnelt electrode, ion trap electrode, slow wave circuit, and collector electrode, respectively, and impressing voltage Va which satisfies the following expression on an accelerating electrode, $$Ib < P\mu \times Va^{3/2}$$

when the beam current emitted from the cold cathode by impressing voltages on the gate electrode is denoted as Ib, and the perveance of the electron gun to be determined according to a form of the electron gun is denoted as $P\mu$.

A third electron tube device mounted with a cold cathode of the present invention comprises:

an electron gun having a cold cathode for emitting electron beam from an array of field emitters, a Wehnelt electrode, a gate electrode and an accelerating electrode;

a collector electrode; and a power supply unit for impressing required voltages on the cold cathode, Wehnelt electrode, gate electrode, accelerating electrode, and collector electrode, respectively, and maintaining the difference between the electric potential of the Wehnelt electrode and that of the gate electrode to a constant value.

A fourth electron tube device mounted with a cold cathode of the present invention is a traveling wave tube device which comprises:

an electron gun having a cold cathode for emitting electron beam from an array of field emitters, a Wehnelt electrode, a gate electrode, an accelerating electrode and an ion trap electrode;

a slow wave circuit;

a collector electrode;

a power supply unit for impressing required voltages on the cold cathode, gate electrode, Wehnelt electrode, accelerating electrode, ion trap electrode, slow wave circuit, and collector electrode, respectively, and maintaining the difference between the electric potential of the Wehnelt electrode and that of the gate electrode at a constant value.

A fifth electron tube device mounted with a cold cathode of the present invention comprises:

an electron gun having a cold cathode for emitting electron beam from an array of field emitters, a gate electrode and an accelerating electrode;

a collector electrode; and a power supply unit for impressing required voltages on the cold cathode, gate electrode, and collector electrode, respectively, and for impressing on the accelerating electrode the highest voltage of the respective electrodes at all times including the operation time, the rise time, the fall time and the time of abnormal operation of the device.

A sixth electron tube device mounted with a cold cathode of the present invention comprises:

an electron gun having a cold cathode for emitting electron beam from an array of field emitters, a gate electrode and an accelerating electrode;

a collector electrode; and a power supply unit for impressing required voltages on the cold cathode, accelerating electrode, gate electrode, and collector electrode, respectively, and for impressing on the electrode which is included in the above electrodes and disposed adjacent to the accelerating electrode the highest voltage of the respective electrodes at all times including the operation time, the rise time, the fall time and the time of abnormal operation of the device.

A seventh electron tube device mounted with a cold cathode of the present invention is a traveling wave tube device comprising:

an electron gun having a cold cathode for emitting an electron beam from an array of field emitters, a gate electrode, a Wehnelt electrode, an accelerating electrode and an ion trap electrode;

a slow wave circuit;

a collector electrode; and a power supply unit for impressing required voltages on the cold cathode, gate electrode, Wehnelt electrode, ion trap electrode, slow wave circuit, and collector electrode, respectively, and for impressing on the accelerating electrode the highest voltage of the respective electrodes at all times including the operation time, the rise time, the fall time, and the time of abnormal operation of the device.

An eighth electron tube device mounted with a cold cathode of the present invention comprises:

an electron gun having a cold cathode for emitting an electron beam from an array of field emitters, a gate electrode, and an accelerating electrode;

a collector electrode; and a power supply unit for impressing required voltages on the cold cathode, gate electrode, accelerating electrode, and collector electrode, respectively, and finally impressing the gate electrode voltage at the rise time of the device and first shutting off the gate electrode voltage at the fall time of the device.

A ninth electron tube device mounted with a cold cathode of the present invention is a traveling wave tube device which comprises:

an electron gun having a cold cathode for emitting an electron beam from an array of field emitters, a gate electrode, a Wehnelt electrode, an accelerating electrode and an ion trap electrode;

a slow wave circuit;

a collector electrode;

a power supply unit for impressing required voltages on the cold cathode, gate electrode, Wehnelt electrode, ion trap electrode, slow wave circuit, and collector electrode, respectively, and finally impressing the gate electrode voltage at the rise time of the device and first shutting off the gate electrode voltage at the fall time of the device.

A tenth electron tube device mounted with a cold cathode of the present invention comprises:

an electron gun having a cold cathode for emitting an electron beam from an array of field emitters, a gate electrode, and an accelerating electrode;

a collector electrode;

a plurality of power supply units for impressing required voltages on the cold cathode, gate electrode, accelerating electrode, and collector electrode, respectively; wherein among a plurality of power supply units, the power supply unit to be connected to the electrode on which the highest voltage is impressed has a voltage drop time constant, at a time of a power supply stop, larger than that of other power supply units connected to other electrodes.

In the above electron tube device mounted with the cold cathode, since the power supply unit connected to the electrode on which the highest voltage is impressed has the voltage drop time constant at the time of the power supply stop larger than that of other power supply units connected to other electrodes, the electric potential of the electrode connected to this power supply unit is securely maintained at the highest level even at the time of the voltage drop.

The power supply unit to be connected to the electrode on which the highest voltage is impressed can be composed of DC power supply and a capacitor, where the DC power supply and the capacitor being connected in parallel.

Further, the power supply unit to be connected to the electrode on which the highest voltage is impressed can be composed of DC power supply and a coil, where the coil being connected in series to an output side of an anode of the DC power supply.

An eleventh electron tube device mounted with a cold cathode of the present invention is a traveling wave tube device comprising:

an electron gun having a cold cathode for emitting an electron beam from an array of field emitters, a gate electrode, a Wehnelt electrode, an accelerating electrode and an ion trap electrode;

a slow wave circuit;

a collector electrode;

a plurality of power supply units for impressing required voltages on the cold cathode, gate electrode, Wehnelt electrode, accelerating electrode, ion trap electrode, slow wave circuit, and collector electrode, respectively; wherein among a plurality of power supply units, the power supply unit to be connected to the electrode on which the highest voltage is impressed has a voltage drop time constant at the time of a power supply stop larger than that of other power supply units connected to other electrodes.

In this traveling wave tube device, in the same way as the tenth electron tube device mounted with the cold cathode, the electric potential of the electrode on which the highest voltage is impressed is securely maintained at the highest level even at the time of the voltage drop due to the power supply stop.

The power supply unit connected to the electrode on which the highest voltage is impressed can be composed of DC power supply and a capacitor, with the DC power supply and the capacitor being connected in parallel.

Further, the power supply unit connected to the electrode on which the highest voltage is impressed can be composed of DC power supply and a coil, with the coil being connected in series to an output side of an anode of the DC power supply.

The above and other object, features, and advantages of the present invention will become apparent from the following description based on the accompanying drawings which illustrate an example of a preferred embodiment of the present invention.

DETAILED DESCRIPTION OF THE PREFERRED EMBODIMENTS

A first embodiment with reference to a method of impressing voltages on electrodes of an electron tube device mounted with a cold cathode of the present invention will be described referring to FIG. 3 and FIG. 12.

Figure 12:
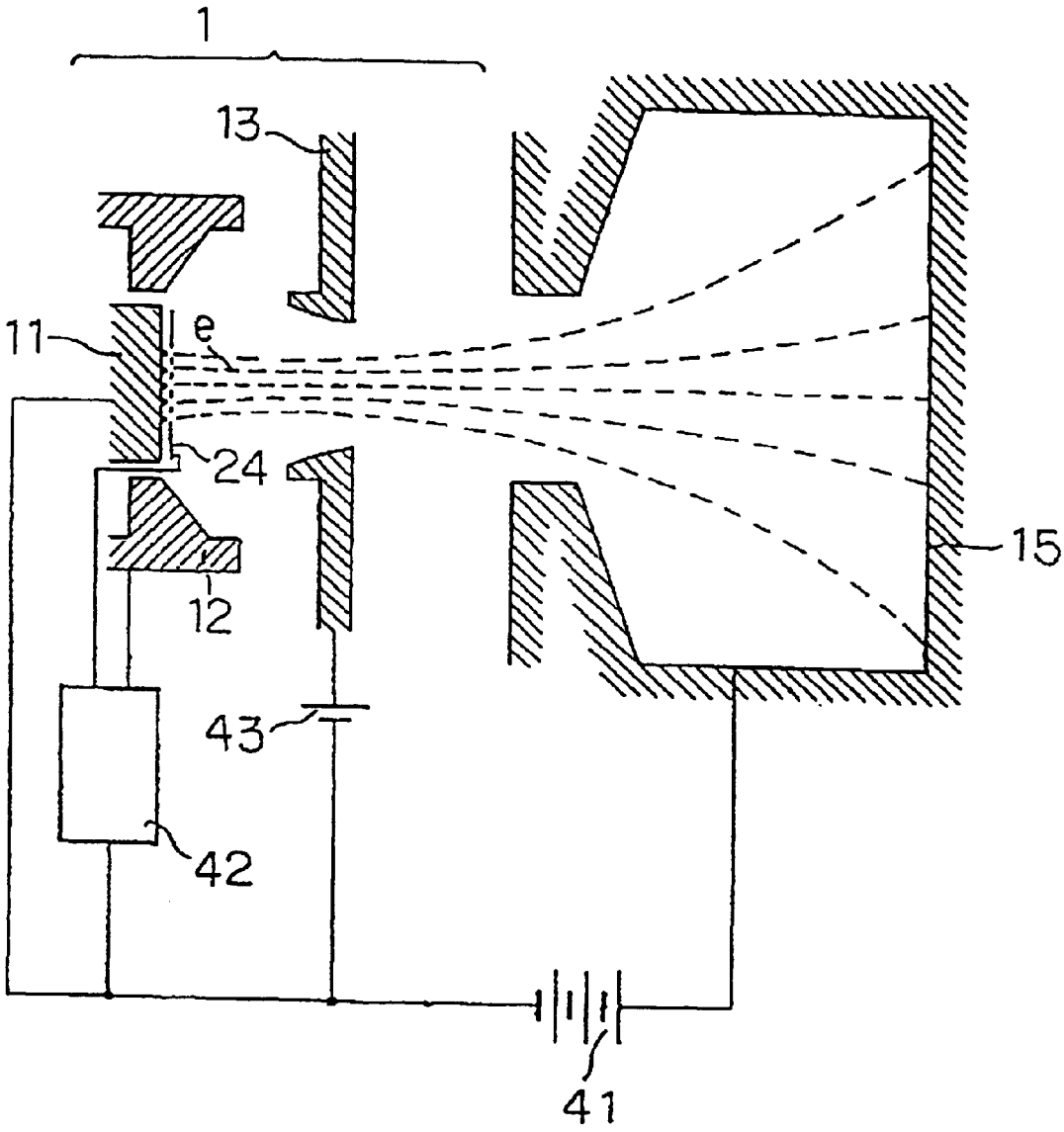
FIG. 12 is a vertical section of the first embodiment with reference to the electron tube device mounted with the cold cathode of the present invention.

An electron tube device mounted with a cold cathode shown in FIG. 12 comprises electron gun 1 and collector electrode 15, electron gun 1 further including cold cathode 11 having an array of field emitters, gate electrode 24 and accelerating electrode 13.

Figure 1A:
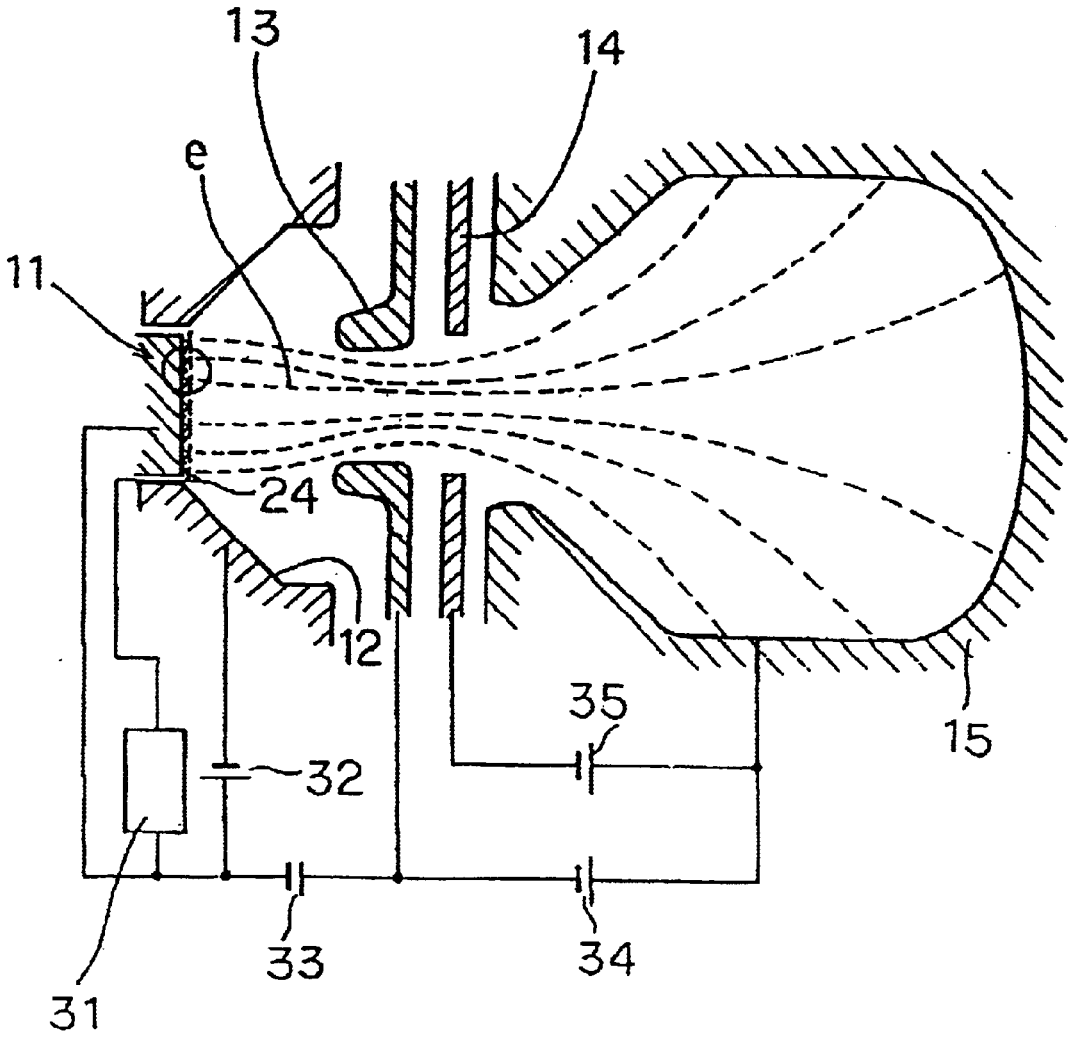
FIG. 1A PRIOR ART
FIG. 1A is a vertical section of a first prior art example of an electron tube device mounted with a cold cathode.
Figure 1B:
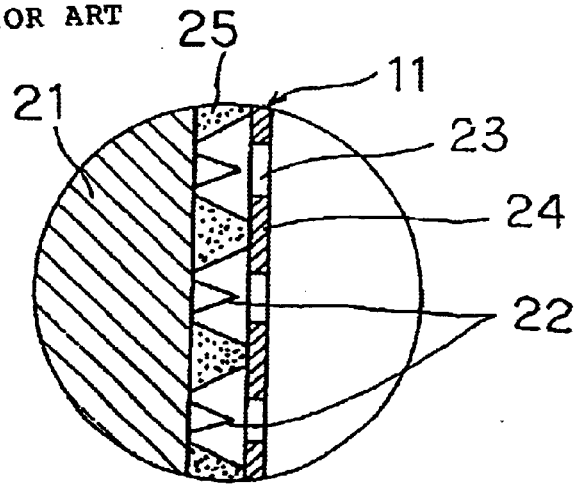
FIG. 1B PRIOR ART
FIG. 1B is an enlarged section of cold cathode 11 of FIG. 1A.
Figure 2:
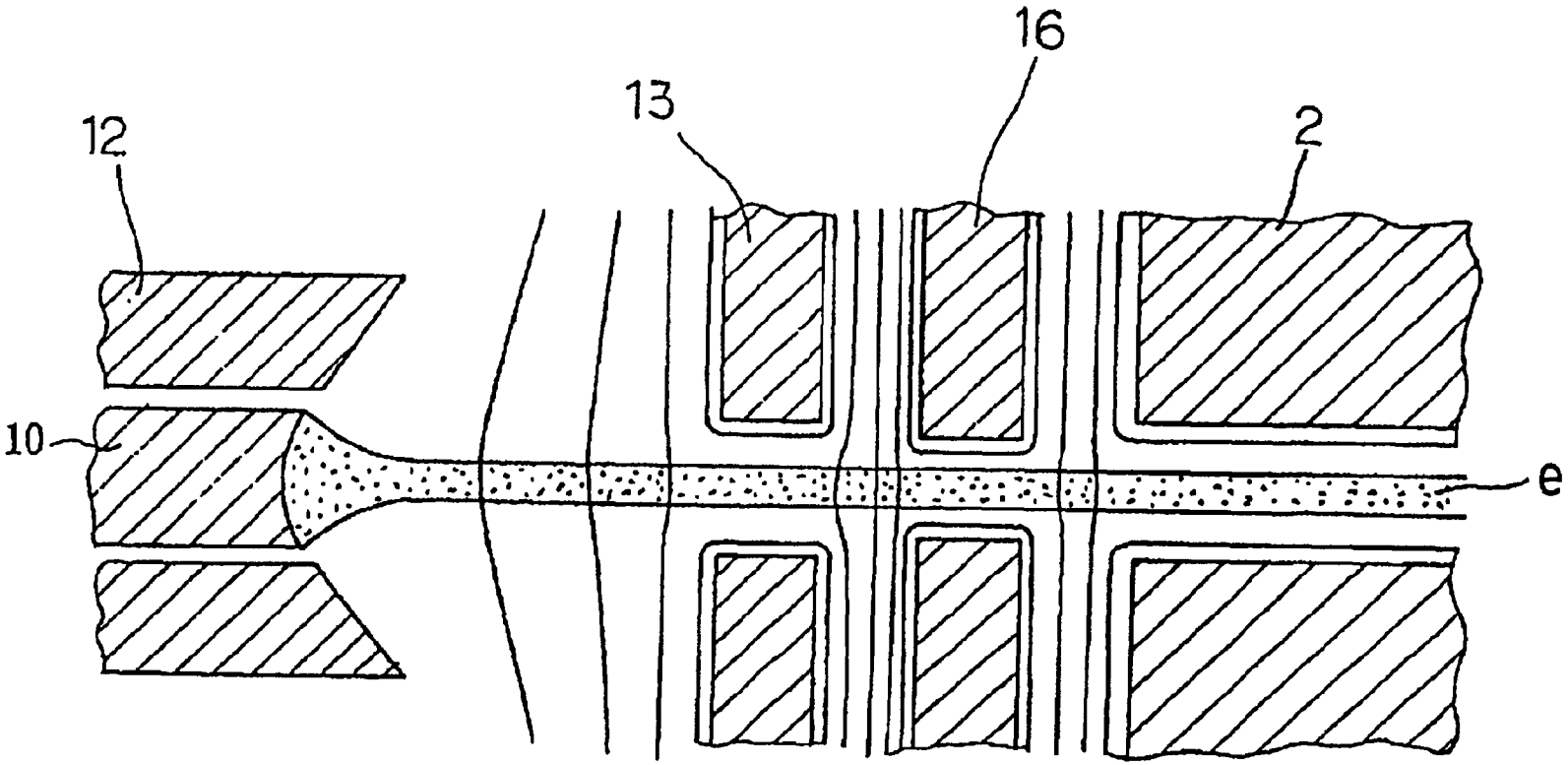
FIG. 2 PRIOR ART
FIG. 2 is a vertical section of a second prior art example of an electron tube device mounted with a cold cathode.
Figure 3:
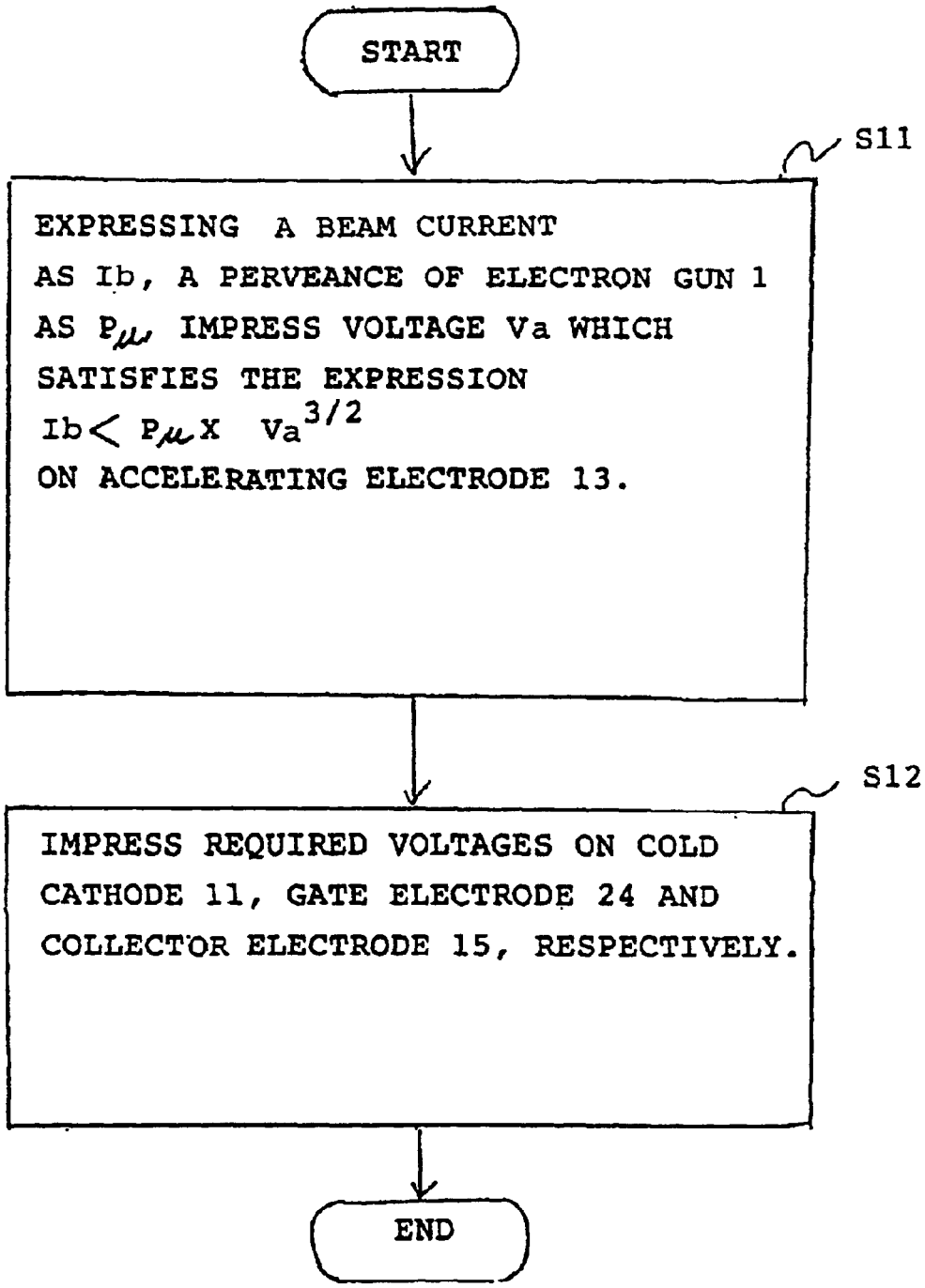
FIG. 3 is a flow chart of a first embodiment with reference to a method of impressing voltages on electrodes of an electron tube device mounted with a cold cathode of the present invention.

A method of impressing voltages on electrodes of this electron tube device mounted with the cold cathode comprises, as shown in FIG. 3, the steps of:

first impressing voltage Va which satisfies the following expression on accelerating electrode 13 (Step S11), $$Ib<P\mu\times Va^{3/2} \quad \text{expression 1}$$

when a beam current emitted from cold cathode 11 by impressing voltage on gate electrode 24 is denoted as Ib, and a perveance of electron gun 1 to be determined according to a form of electron gun 1 is denoted as $P\mu$; and then impressing required voltages on cold cathode 11, gate electrode 24 and collector electrode 15, respectively (Step S12).

In the electron tube device mounted with the cold cathode, as shown in FIG. 12, by impressing an appropriate voltage on gate electrode 24, electrons corresponding to electric currents determined by the voltage of gate electrode 24 are emitted from cold cathode 11, electrons are accelerated by accelerating electrode 13, and radiated to collector electrode 15 which has been impressed with voltage 41. At this time when the beam current is emitted from cold cathode 11 exceeding a product of a perveance of the electron gun and the 3/2 power of the impressed voltage, the beam is made to diverge strongly by the space charge effect thereby colliding with accelerating electrode 13. Consequently, gas leaves accelerating electrode 13, and then the gas and the beam collide with each other to produce positive ions. The positive ions are also directly generated from accelerating electrode 13. The positive ions generated between the cold cathode and the accelerating electrode proceed toward the cold cathode of low electric potential. Collision of positive ions against cold cathode 11 causes deterioration of the cold cathode. However, in the present embodiment, since the beam current is less than the product of the perveance of the electron gun and the 3/2 power of the accelerating electrode voltage, the divergence of the beam is controllable even when the beam is made to diverge by the space charge effect and the beam scarcely collides with accelerating electrode 13. Accordingly, positive ions are scarcely generated between the cold cathode and the accelerating electrode and hence no deterioration of the characteristic of the cold cathode is observed.

A second embodiment with reference to the method of impressing voltages on electrodes of the electron tube device mounted with the cold cathode of the present invention will be described referring to FIG. 4 and FIG. 13.

Figure 13:
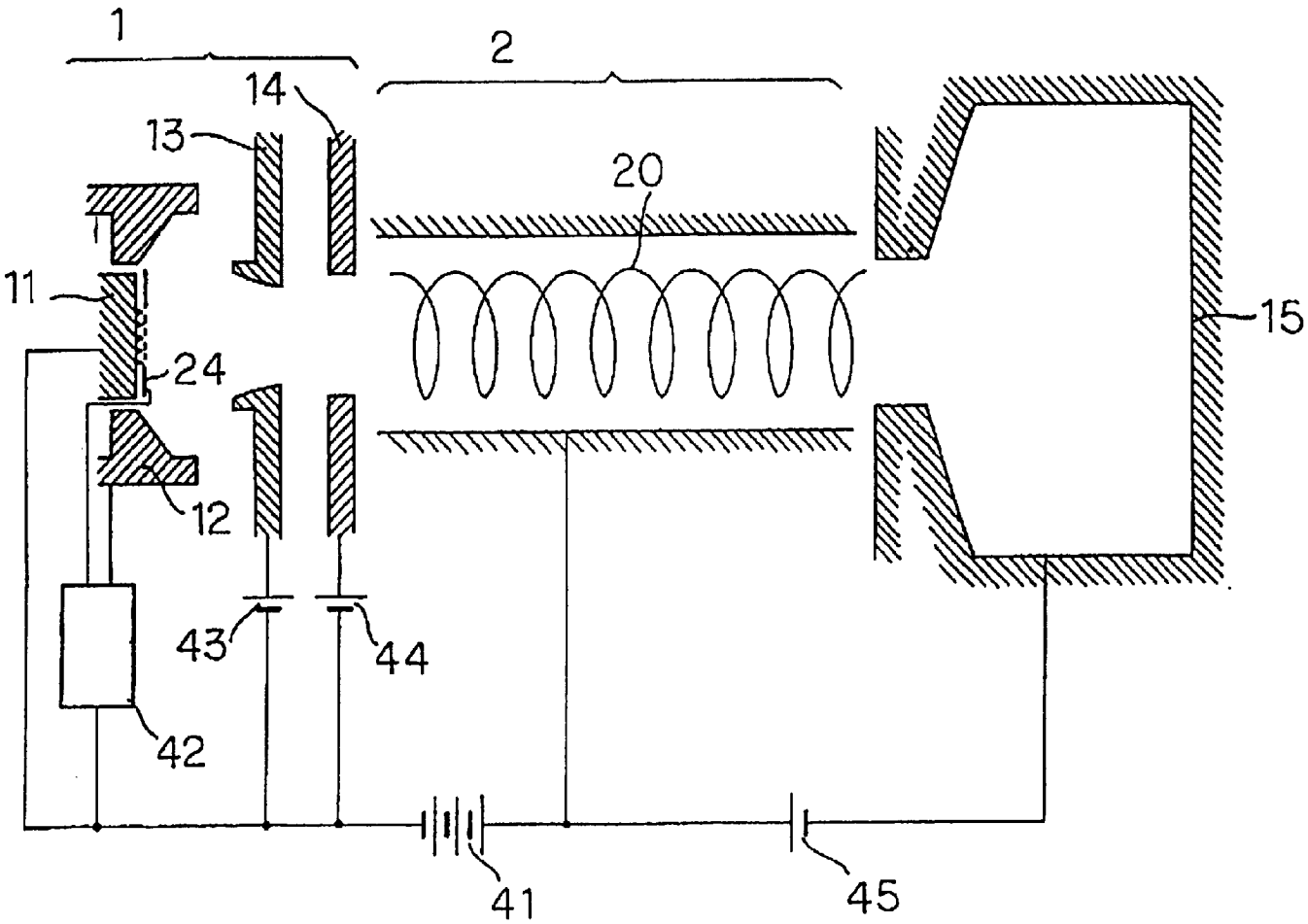
FIG. 13 is a vertical section of a traveling wave tube device mounted with a cold cathode which constitutes a second embodiment of the electron tube device mounted with the cold cathode of the present invention.

The electron tube device mounted with a cold cathode shown in FIG. 13 is a traveling wave tube device comprising electron gun 1, slow wave circuit 2 and collector electrode 15, electron gun 1 further including cold cathode 11 having an array of field emitters, Wehnelt electrode 12, accelerating electrode 13, gate electrode 24 and ion trap electrode 14.

Figure 4:
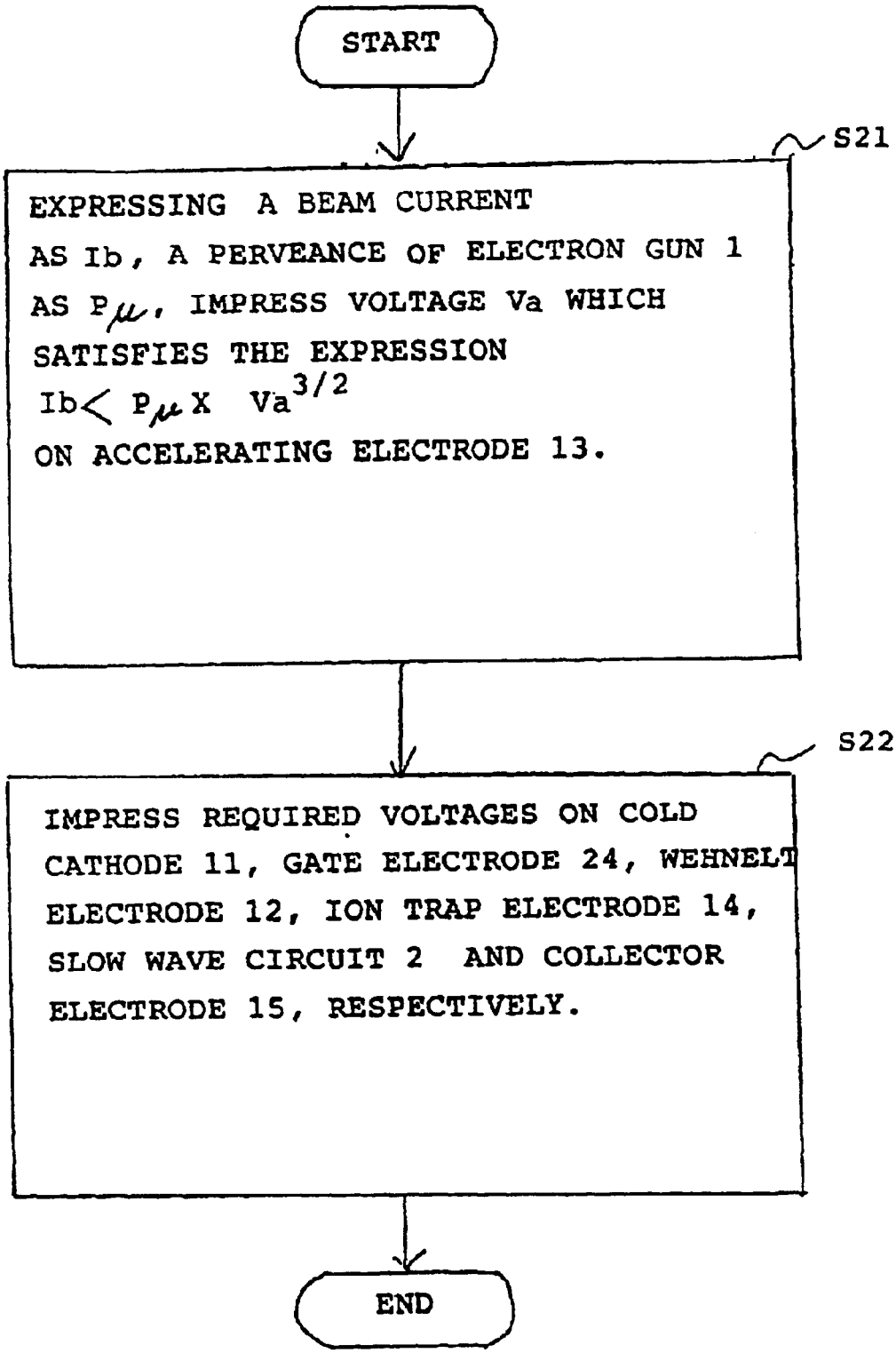
FIG. 4 is a flow chart of a second embodiment with reference to the method of impressing voltages on the electrodes of the electron tube device mounted with the cold cathode of the present invention.

A method of impressing voltages on electrodes of this electron tube device mounted with the cold cathode comprises, as shown in FIG. 4, the steps of:

first impressing voltage Va which satisfies the following expression on accelerating electrode 13 (Step S21), $$Ib<P\mu\times Va^{3/2} \quad \text{expression 1}$$

when the beam current emitted from cold cathode 11 by impressing voltage on gate electrode 24 is denoted as Ib, and the perveance of electron gun 1 to be determined according to the form of electron gun 1 is denoted as $P\mu$; and then impressing required voltages on cold cathode 11, gate electrode 24, Wehnelt electrode 12, ion trap electrode 14, slow wave circuit 2 and collector electrode 15, respectively (Step S22).

In the present embodiment, as shown, for example, in FIG. 13, since the voltage which satisfies expression 1 is impressed on accelerating electrode 13, electrons emitted from cold cathode 11 reach collector electrode 15 through the inside of helix 20 of slow wave circuit 2 without striking accelerating electrode 13 and ion,trap electrode 14. Since electrons do not strike accelerating electrode 13, ion trap electrode 14 and helix 20, no impact damage is caused by positive ions on cold cathode 11 thereby allowing it to perform stable operation.

A third embodiment with reference to the method of impressing voltages on electrodes of the electron tube device mounted with the cold cathode of the present invention will be described referring to FIG. 5 and FIG. 12.

In order to make the electron tube mounted with the cold cathode operate in a stable manner, it is necessary to control an elapse change of an emission current to be emitted from cold cathode 11. Control of the amount of emission can be realized by the voltage control of gate 24. If there is an Wehnelt electrode and the voltage to be impressed on Wehnelt electrode (hereinafter referred to as Wehnelt voltage) is constant, and yet the gate voltage is changed (particularly increased), there is a possibility of electrons colliding with accelerating electrode 13. Therefore, for realizing stable operation in which accelerating electrode 13 is never subjected to the collision of electrons, it is required to control the Wehnelt voltage in accordance with a controlled gate voltage.

Figure 5:
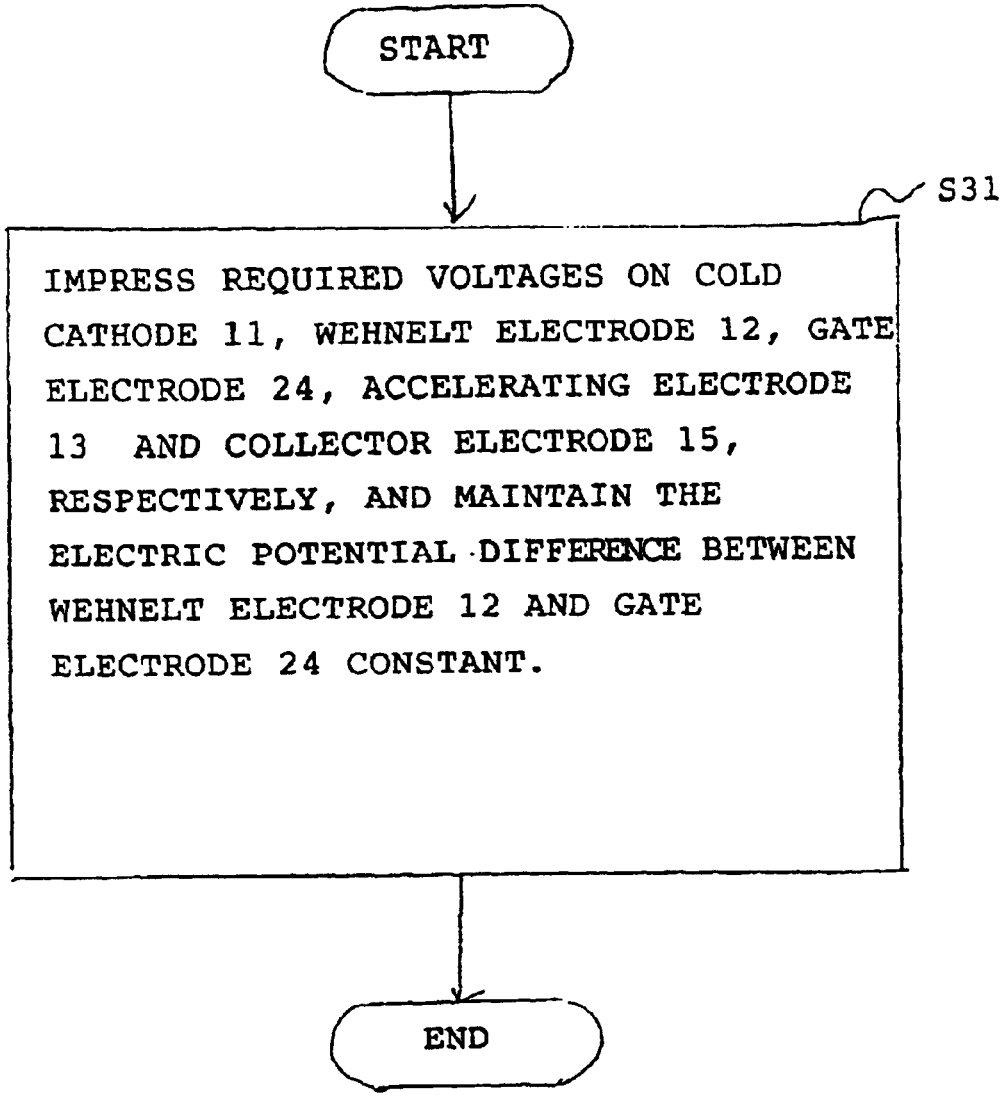
FIG. 5 is a flow chart of a third embodiment with reference to the method of impressing voltages on the electrodes of the electron tube device mounted with the cold cathode of the present invention.

This electrode voltage impressing method is the method of impressing an electrode voltage of the electron tube device mounted with the cold cathode having the Wehnelt electrode, as shown in FIG. 5, the method comprising the steps of:

impressing required voltages on cold cathode 11, Wehnelt electrode 12, gate electrode 24, accelerating electrode 13 and collector electrode 15, respectively and controlling to maintain the difference in the electric potential between Wehnelt electrode 12 and gate electrode 24 at a constant value (Step S31).

In this embodiment, since the difference in the electric potential between Wehnelt electrode 12 and gate electrode 24 is kept constant, the collision of electron beam against accelerating electrode 13 is controlled to a minimum and deterioration of the element characteristic is repressed.

A fourth embodiment with reference to the method of impressing voltages on electrodes of the electron tube device mounted with the cold cathode of the present invention will be described referring to FIG. 6 and FIG. 15.

Figure 6:
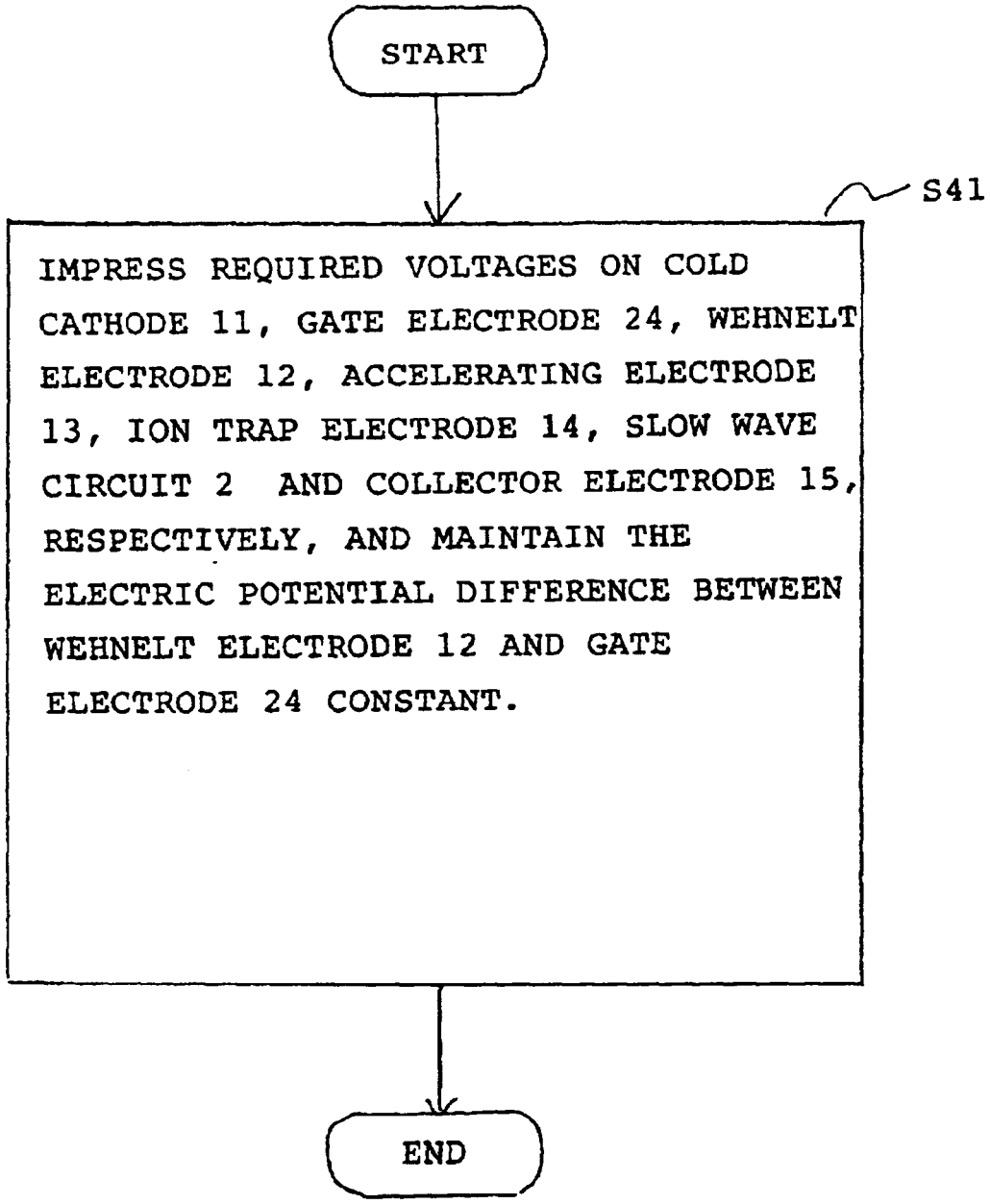
FIG. 6 is a flow chart of a fourth embodiment with reference to the method of impressing voltages on the electrodes of the electron tube device mounted with the cold cathode of the present invention.
Figure 15:
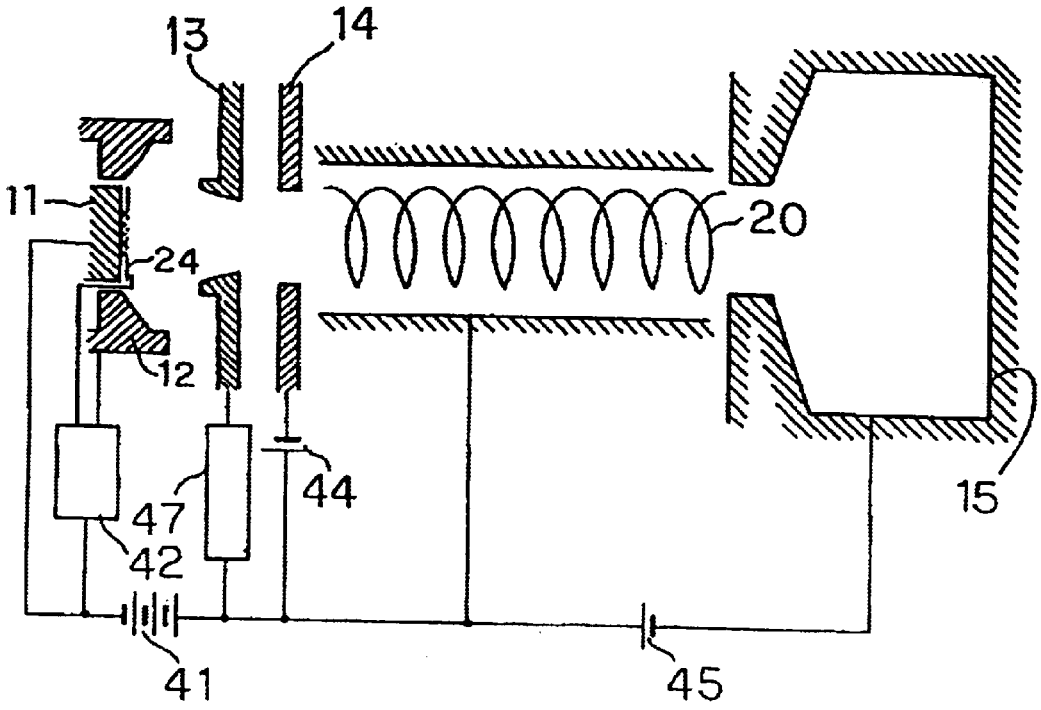
FIG. 15 is a vertical section of a traveling wave tube device mounted with a cold cathode which constitutes a fourth embodiment of the electron tube device mounted with the cold cathode of the present invention.

This embodiment shows the method of impressing an electrode voltage of the traveling wave tube device mounted with the cold cathode having the Wehnelt electrode shown in FIG. 15, the method comprising, as shown in FIG. 6, the steps of:

impressing required voltages on cold cathode 11, gate electrode 24, Wehnelt electrode 12, accelerating electrode 13, ion trap electrode 14, slow wave circuit 2 and collector electrode 15, respectively and controlling to maintain the difference in the electric potential between Wehnelt electrode 12 and gate electrode 24 to a constant value (Step S41).

In this embodiment, since gate electrode 24 and the Wehnelt electrode 12 are controlled while maintaining the constant electric potential difference between the two, the collision of the electron beam against accelerating electrode 13 is controlled to a minimum.

A fifth embodiment with reference to the method of impressing voltages on electrodes of the electron tube device mounted with the cold cathode of the present invention will be described referring to FIG. 7 and FIG. 12.

Figure 7:
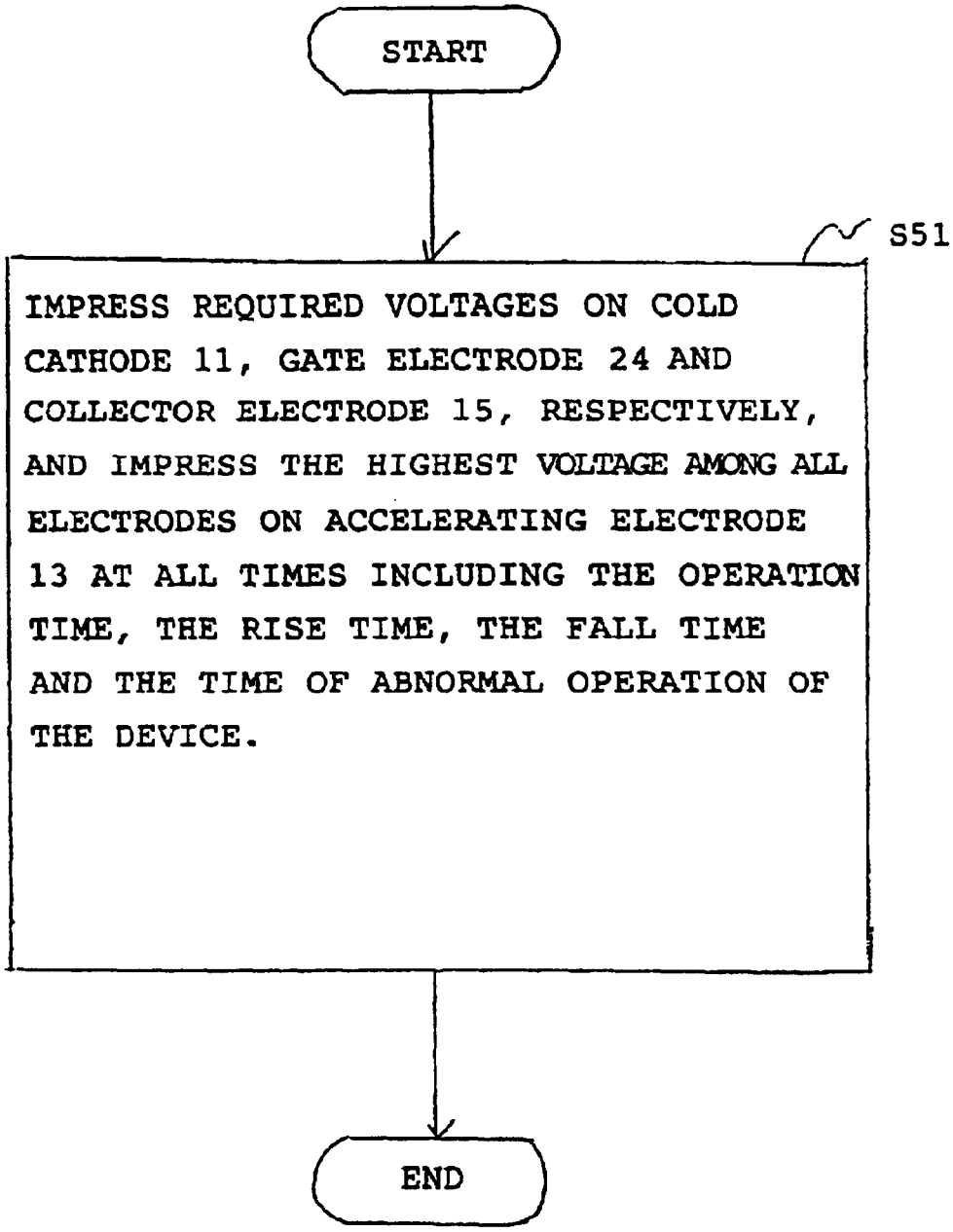
FIG. 7 is a flow chart of a fifth embodiment with reference to the method of impressing voltages on the electrodes of the electron tube device mounted with the cold cathode of the present invention.

This electrode voltage impressing method comprises, as shown in FIG. 7, the steps of:

first impressing required voltages on cold cathode 11, gate electrode 24 and collector electrode 15, respectively, and impressing the highest voltage among the respective electrode voltages on accelerating electrode 13 at all times including the operation time, the rise time, the fall time and the time of abnormal operation of the device (Step S51).

In the present embodiment, since the electric potential of the accelerating electrode voltage always becomes the highest, even if an abnormality is generated in the power supply, positive ions generated in the electron tube are repelled by the electric field produced by the accelerating electrode, and hence the positive ions do not reach cold cathode 11 thereby allowing to control the deterioration of cold cathode 11 to a minimum.

A sixth embodiment with reference to the method of impressing voltages on electrodes of the electron tube device mounted with the cold cathode of the present invention will be described referring to FIG. 8 and FIG. 12.

Figure 8:
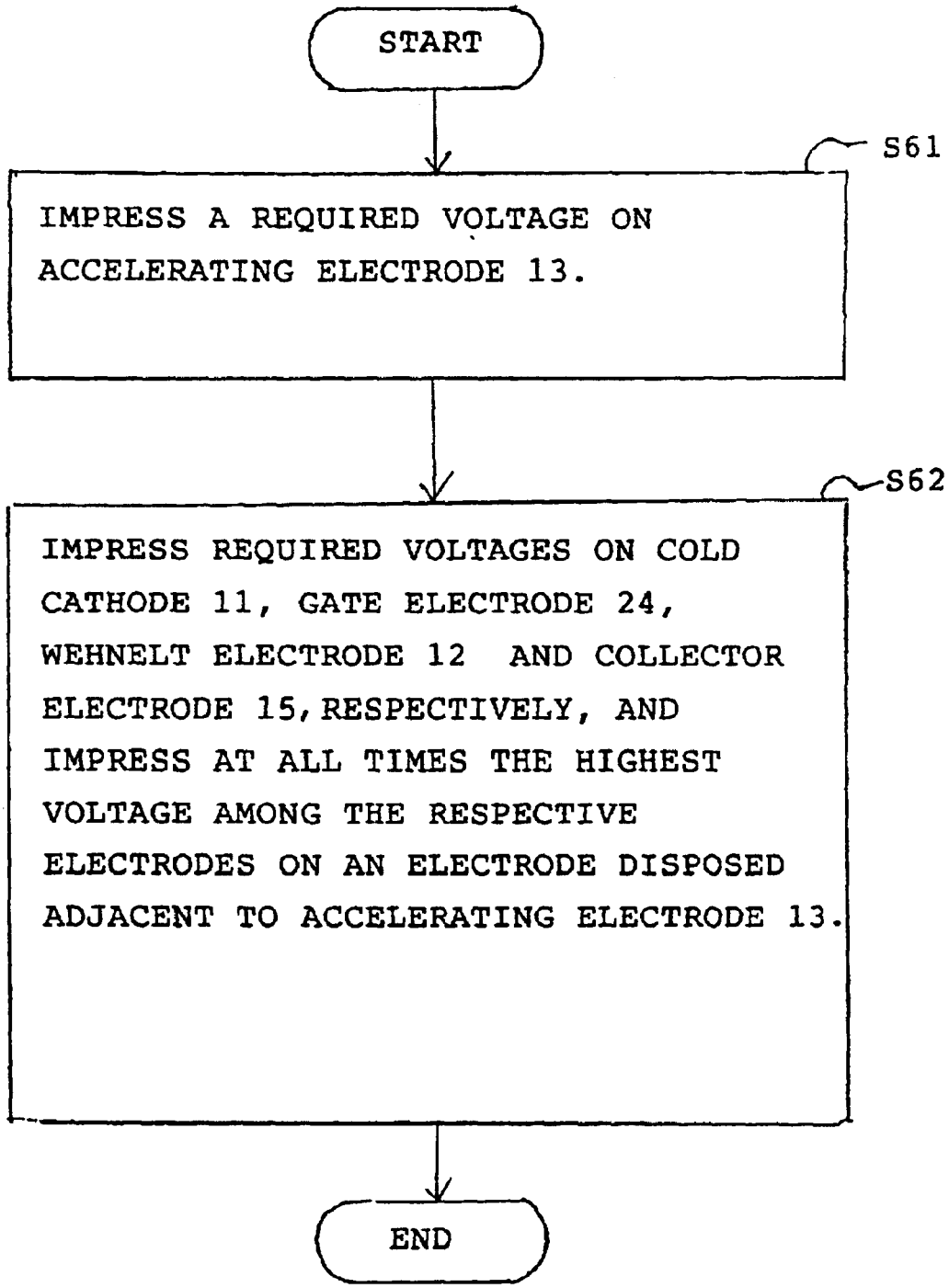
FIG. 8 is a flow chart of a sixth embodiment with reference to the method of impressing voltages on the electrodes of the electron tube device mounted with the cold cathode of the present invention.

As shown in FIG. 8, this electrode voltage impressing method comprises the steps of:

first impressing a required voltage on accelerating electrode 13 (Step S61); and impressing required voltages on cold cathode 11, gate electrode 24, Wehnelt electrode 12 and collector electrode 15, respectively, and impressing the highest voltage among the respective electrode voltages on an electrode (not shown) adjacent to accelerating electrode 13 (Step S62).

In this embodiment, since the electrode adjacent to the accelerating electrode has the highest electric potential, even if an abnormality occurs in the power supply, generated positive ions are repelled by the electric field produced by this electrode and do not reach cold cathode 11.

A method of impressing an electrode voltage of the traveling wave tube device which forms a seventh embodiment with reference to the method of impressing voltages on electrodes of the electron tube device mounted with the cold cathode of the present invention will be described referring to FIG. 9 and FIG. 13.

Figure 9:
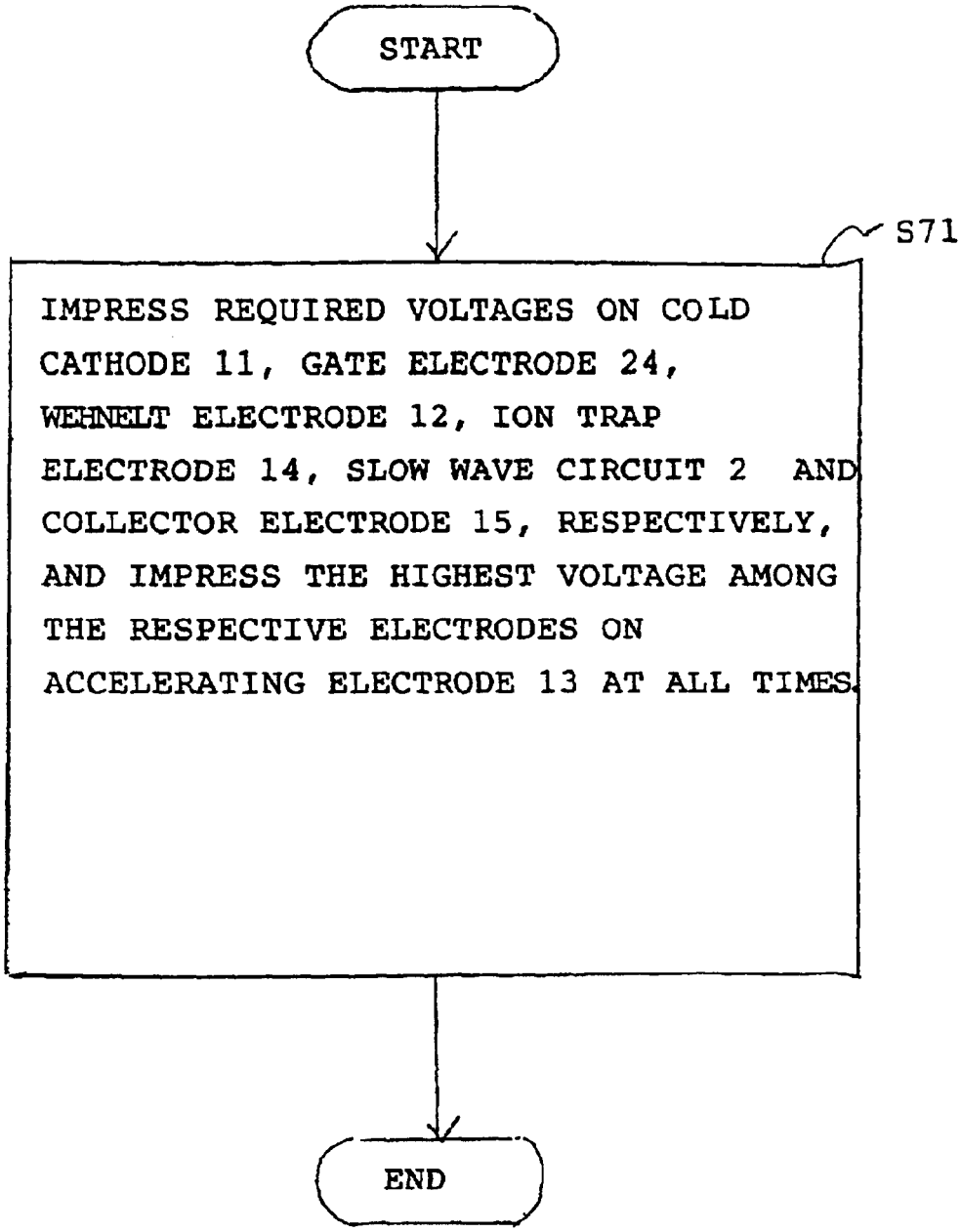
FIG. 9 is a flow chart of a seventh embodiment with reference to the method of impressing voltages on the electrodes of the electron tube device mounted with the cold cathode of the present invention.

As shown in FIG. 9, the above electrode voltage impressing method comprises the step of:

impressing required voltages on cold cathode 11, gate electrode 24, Wehnelt electrode 12, ion trap electrode 14, slow wave circuit 2 and collector electrode 15, respectively, and impressing the highest voltage of the respective electrode voltages on accelerating electrode 13 at all times including the operation time, the rise time, the fall time and the time of an abnormal operation of the device (Step S71).

According to this electrode voltage impressing method, since accelerating electrode 13 has the highest electric potential among respective electrodes, even if an abnormality occurs in the power supply, generated positive ions are repelled by the electric field produced by accelerating electrode 13 and do not reach cold cathode 11.

An eighth embodiment with reference to the method of impressing voltages on electrodes of the electron tube device mounted with the cold cathode of the present invention will be described referring to FIG. 10 and FIG. 12.

Figure 10:
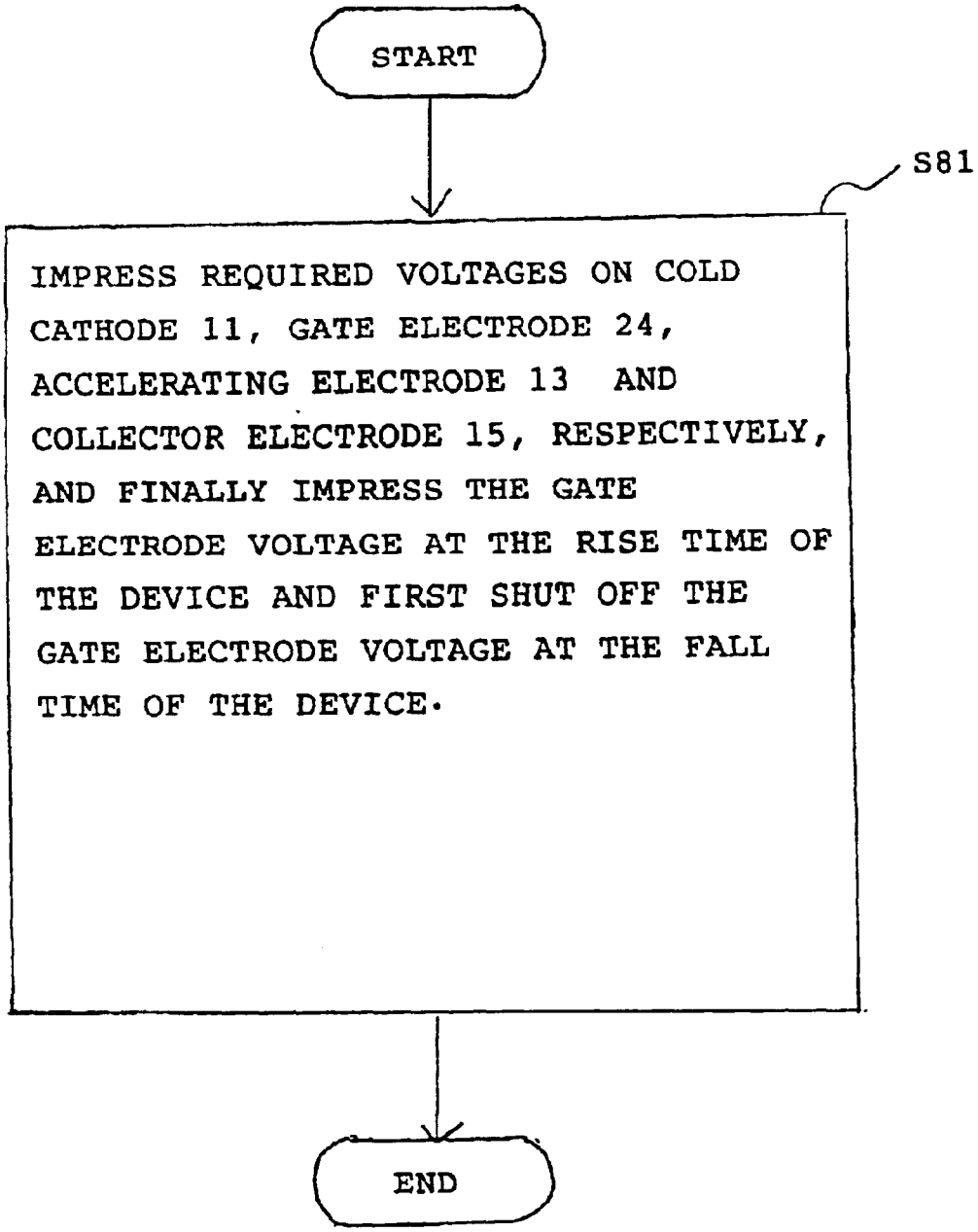
FIG. 10 is a flow chart of an eighth embodiment with reference to the method of impressing voltages on the electrodes of the electron tube device mounted with the cold cathode of the present invention.

As shown in FIG. 10, this electrode voltage impressing method comprises the step of:

impressing required voltages on cold cathode 11, gate electrode 24, accelerating electrode 13 and collector electrode 15, respectively, and finally impressing voltage on gate electrode 24 at the rise time of the device and first shutting off the voltage of gate electrode 24 at the fall time of the device (Step S81).

According to the above electrode voltage impressing method, since no electron beam is emitted from the cold cathode in the state that voltages are not impressed on electrodes other than the gate electrode, there is no possibility of that electron beams will collide with electrodes other than the collector electrode and generate positive ions, and hence the cold cathode is not deteriorated.

A method of impressing voltages on electrodes of the traveling wave tube device which represents a ninth embodiment with reference to the method of impressing voltages on electrodes of the electron tube device mounted with the cold cathode of the present invention will be described referring to FIG. 11 and FIG. 13.

Figure 11:
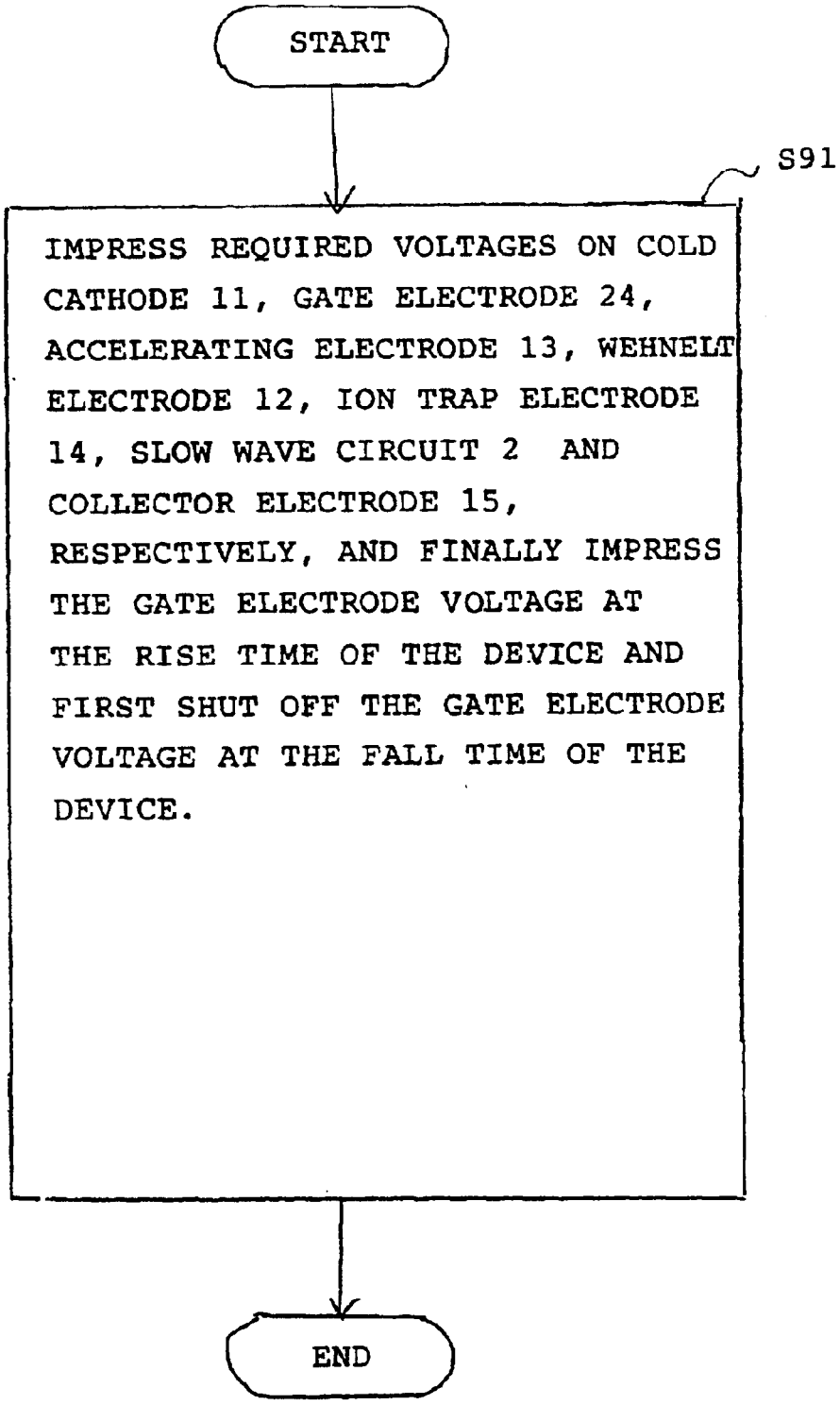
FIG. 11 is a flow chart of a ninth embodiment with reference to the method of impressing voltages on the electrodes of the electron tube device mounted with the cold cathode of the present invention.

As shown in FIG. 11, the above electrode voltage impressing method comprises the step of:

impressing required voltages on cold cathode 11, gate electrode 24, accelerating electrode 13, Wehnelt electrode 12, ion trap electrode 14, slow wave circuit 2 and collector electrode 15, respectively, and finally impressing voltage on gate electrode 24 at the rise time of the device and first shutting off the voltage of gate electrode 24 at the fall time of the device (Step S91).

According to the above electrode voltage impressing method, since no electron beam is emitted in the state that voltages are not impressed on electrodes other than the gate electrode, the cold cathode is not deteriorated by the collision of positive ions.

A first embodiment of an electron tube device mounted with a cold cathode of the present invention will be described with reference to FIG. 12.

In the electron tube device mounted with the cold cathode, an electron tube comprises electron gun 1 and collector electrode 15. Electron gun 1 includes cold cathode 11, gate electrode 24, Wehnelt electrode 12, accelerating electrode 13 which are all provided on the same axis with predetermined spaces. Here, if a beam current is denoted as Ib (A), a voltage to be impressed on accelerating electrode 13, that is, an accelerating voltage Va (V) and a perveance of the electron gun $P\mu$, beam current Ib is determined by power supply 42 and accelerating voltage Va is determined by power supply 43 so that they satisfy the following relationship.

$$Ib < P\mu \times Va^{3/2} \qquad \text{expression 1}$$

Although this electron tube device does not include an ion trap electrode in electron gun 1, it is allowable to include the same in electron gun 1.

In the present embodiment, since the beam current is less than the product of a perveance of the electron gun and the 3/2 power of the accelerating electrode voltage, the divergence of the beam is controllable even if the beam is forced to diverge due to space charge effects and hence the beam scarcely collide with accelerating electrode 13. Accordingly, positive ions are hardly generated between the cold cathode and the accelerating electrode, and hence no deterioration is observed with reference to the characteristic of the cold cathode.

A second embodiment of the electron tube device mounted with the cold cathode of the present invention will be described with reference to FIG. 13.

This electron tube mounted with the cold cathode is a traveling wave tube, and in FIG. 13 and the following drawings, magnets the provided on a part of the traveling wave tube outside the casing and outside the outside casing near helix 20 are omitted.

In the electron tube mounted with the cold cathode, slow wave circuit 2 is disposed between electron gun 1 and collector 15. By impressing voltages in a range of several tens V to a hundred and several tens V by power supply 42 on gate electrode 24, the beam current is controlled, and by impressing voltage on Wehnelt electrode 12 so that the electric potential thereof becomes equivalent to that of the gate electrode or becomes lower than that of the gate electrode but higher than that of the emitter, the divergence of the beam is controlled. On helix 20 of slow wave circuit 2, a voltage of several kV is impressed by power supply 41, and on collector 15 a voltage equivalent to that of helix 20 is impressed by power supply 41 or a voltage negative to that of the helix is impressed by power supply 45. In order to acquire positive ions proceeding toward electron gun 1 from helix 20, a voltage lower than voltages of the helix and the collector electrode are impressed on ion trap electrode 14 by power supply 44, and a voltage which satisfies expression 1 is impressed on accelerating electrode 13 by power supply 43.

Electrons emitted from cold cathode 11 under the voltage impressing condition which satisfies expression 1 reach collector electrode 15 through the inside of helix 20 without striking accelerating electrode 13 and ion trap electrode 14. Since the electrons do not strike accelerating electrode 13, ion trap electrode 14 and helix 20, cold cathode 11 can perform stable operation without being damaged by impulse of positive ions.

A third embodiment of the electron tube device mounted with the cold cathode of the present invention will be described with reference to FIG. 14.

This electron tube mounted with the cold cathode is also a traveling wave tube. In the same way as the case of FIG. 13, on helix 20 of slow wave circuit 2, a voltage of several kV is impressed by power supply 41, and on collector 15 a voltage equivalent to that of helix 20 is impressed by power supply 41 or a voltage negative to that of the helix is impressed by power supply 45. In order to acquire positive ions proceeding toward electron gun 1 from helix 20, a voltage lower than voltages of the helix and the collector electrode are impressed on ion trap electrode 14 by power supply 44, and a voltage which satisfies expression 1 is impressed on accelerating electrode 13 by power supply 43. Since a voltage which satisfies expression 1 is impressed on acclerating electrode 13 by power supply 43, cold cathode 11 is arranged so that no impulse damage will be caused by positive ions thereon. Further, it is necessary to control the time elapsed change of the emission currents emitted from cold cathode 11 for securing the stable operation of the traveling wave tube. Control of the emission current is realized by voltage control of gate electrode 24. When the Webnelt voltage is kept constant and the gate voltage is varied, there is a possibility of having electrons which may strike accelerating electrode 13.

In the traveling wave tube mounted with the cold cathode of this embodiment, power supply 46 is provided for maintaining the difference in the electric potential of gate electrode 24 and Wehnelt electrode 12 to a constant value, and power supply 42 is provided for controlling Wehnelt electrode 12 so that the electric potential thereof can automatically be changed.

According to the above control, the collision of electron beam against the accelerating electrode are controlled to a minimum, thereby repressing the deterioration of the element characteristics.

Figure 16:
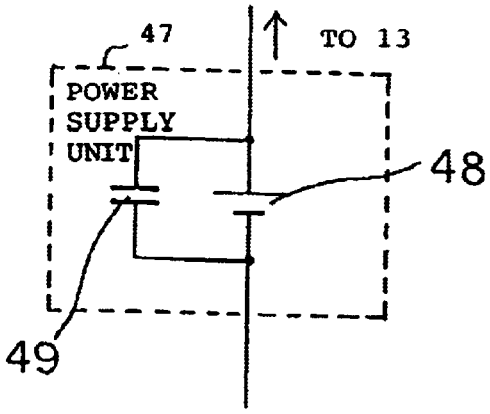
FIG. 16 is a circuit diagram of power supply unit 47 of FIG. 15.
Figure 17:
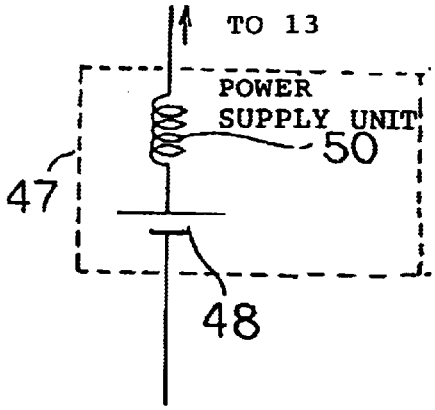
FIG. 17 is another circuit diagram of power supply unit 47 of FIG. 15.

A fourth embodiment of the electron tube device mounted with the cold cathode of the present invention will be described with reference to FIGS. 15, 16 and 17.

This embodiment also shows, in FIG. 15, for example, a traveling wave tube mounted with a cold cathode, and it differs from the electron tube device of FIG. 13 in that power supply unit 47 is employed in place of power supply 43. Power supply 47 impresses voltage on accelerating electrode 13 so that a positive voltage is impressed against helix 20 which serves as a reference. Cold cathode 11, ion trap electrode 14, collector electrode 15 receive voltages from power supply 41, 44 and 45 respectively, the voltages being negative against helix 20 which is used as the reference. Impressing voltage on gate electrode 24 by power supply 42 is arranged such that a voltage is finally impressed at the operation rise time of the electron tube and first cut at the fall time or at the time of emergency stop thereof.

A voltage drop time constant at the rise time of power supply unit 47 is larger when compared to those of power supply 41, 44 and 45. As shown in FIG. 16, a structure of power supply unit 47 can be realized by DC source 48 and capacitor 49, connected in parallel, DC source 48 having a voltage drop time constant equivalent to those of power supply 41, 44 and 45. Or, as shown in FIG. 17, the structure of power supply unit 47 can be realized by constructing it with DC source 48 and coil 50 connected in series to the anode side of DC source 48 which has a voltage drop time constant equivalent to those of power supply 41, 44 and 45. Further, power supply unit 47 can be constituted by using both capacitor 49 of FIG. 16, and coil 50 of FIG. 17, in combination with DC source 48. By using power supply unit 47, the electric potential of accelerating electrode 13 can be maintained at the highest level compared to those of other electrodes at the rise time and the time of emergency stop of the unit.

According to the electrode voltage impressing method of the present embodiment, ON/OFF operation of power supply 42 for controlling the beam current at the rise time, the fall time and the time of the emergency stop of the electron tube device is performed in the state that other power supply are all impressed. Consequently, collision of positive ions with cold cathode 11 can be prevented in the same manner as the time of normal operation. Further, since the accelerating electrode voltage can always have the highest electric potential, even if an abnormality occurs in the power supply, positive ions generated in helix 20 and collector 15 are repelled by the electric field produced by accelerating electrode 13 connected to power supply unit 47 thereby failing to reach cold cathode 11. Therefore, the deterioration of cold cathode 11 can be controlled to a minimum.

In the present embodiment, the electric potential of accelerating electrode 13 is at the highest level, however, even if there is another electrode (not shown) disposed adjacent to accelerating electrode 13 on the side of collector electrode 15 and the highest electric potential is impressed on that electrode, since positive ions are repelled by the electric field of that electrode, the deterioration of cold cathode 11 is prevented.

A fifth embodiment of the electron tube device mounted with the cold cathode of the present invention will be described with reference to FIGS. 18 and 19.

Figure 14:
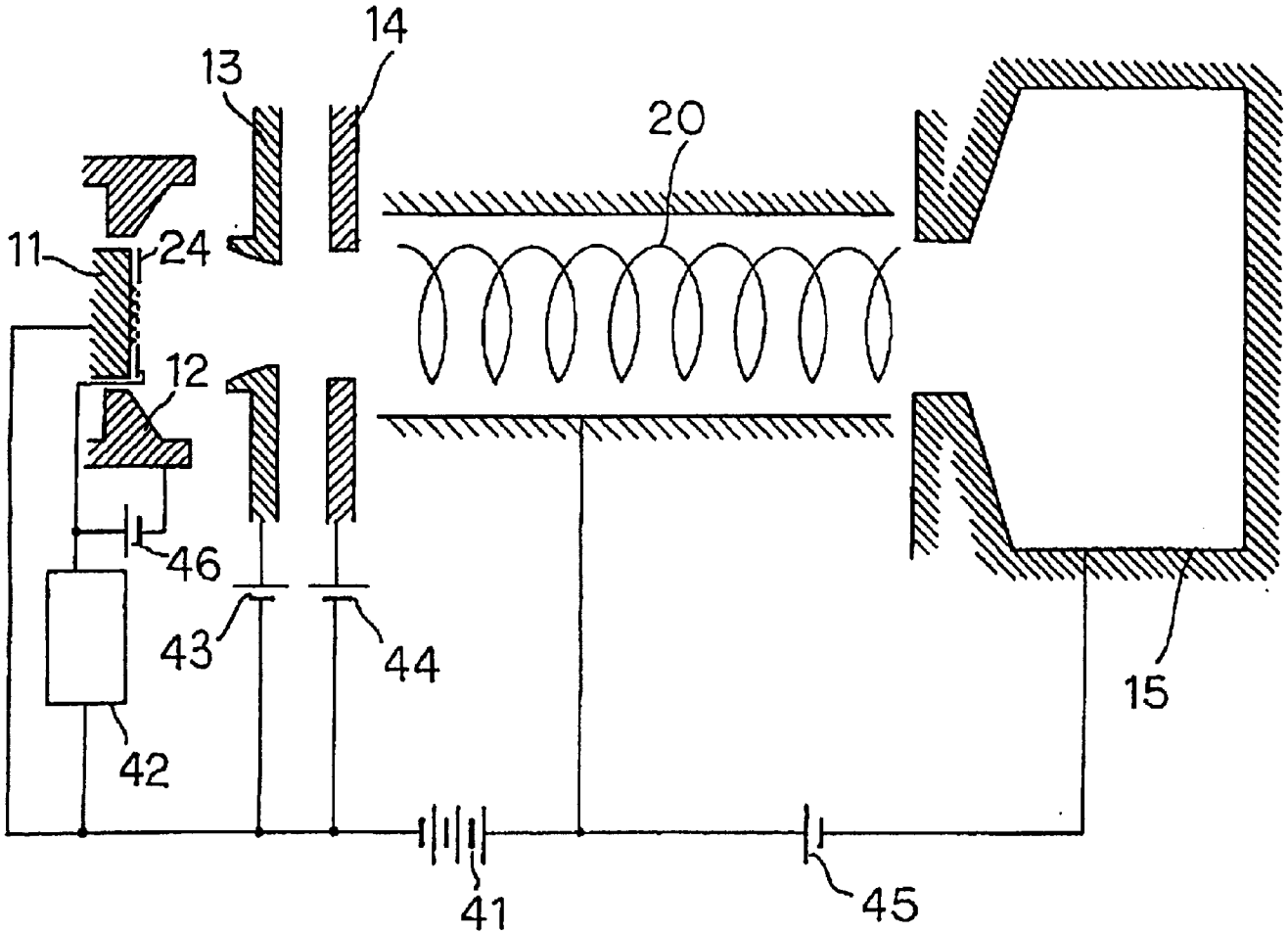
FIG. 14 is a vertical section of a traveling wave tube device mounted with a cold cathode which constitutes a third embodiment of the electron tube device mounted with the cold cathode of the present invention.

The electron tubes in FIGS. 13 to 15 are provided with the ion trap electrode. However, the electron tube of this embodiment is a cathode ray tube (hereinafter referred to as CRT) illustrated as an example of an electron tube which is not provided with an ion trap electrode. In FIG. 18, an outside casing and CRT structure members other than the electron gun are omitted, and in FIG. 19, support structures of grids 26, 27, 28 and 29 are omitted.

Figure 18:
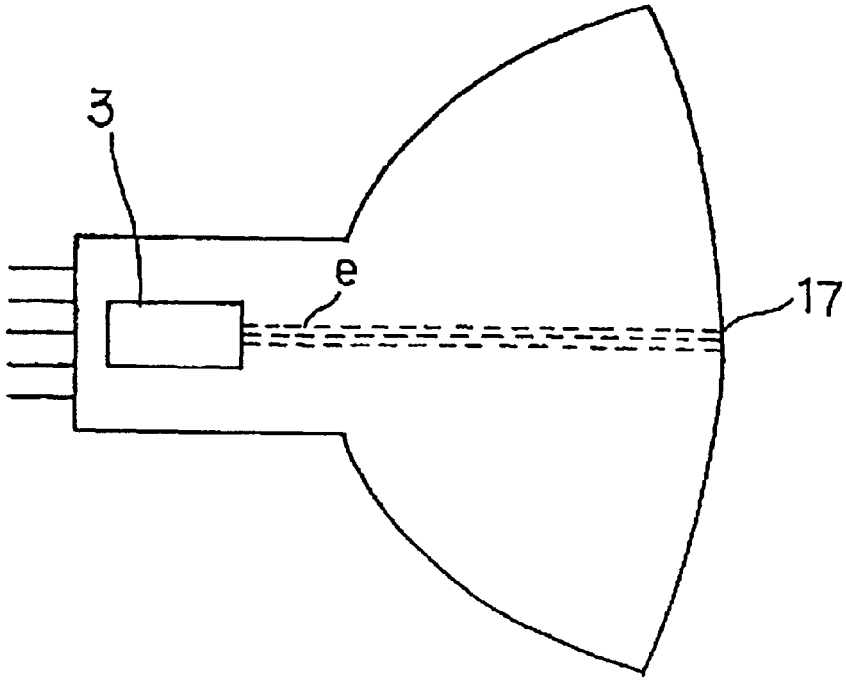
FIG. 18 is a vertical section of a cathode ray tube (hereinafter called CRT) which constitutes a fifth embodiment of the electron tube device mounted with the cold cathode of the present invention.
Figure 19:
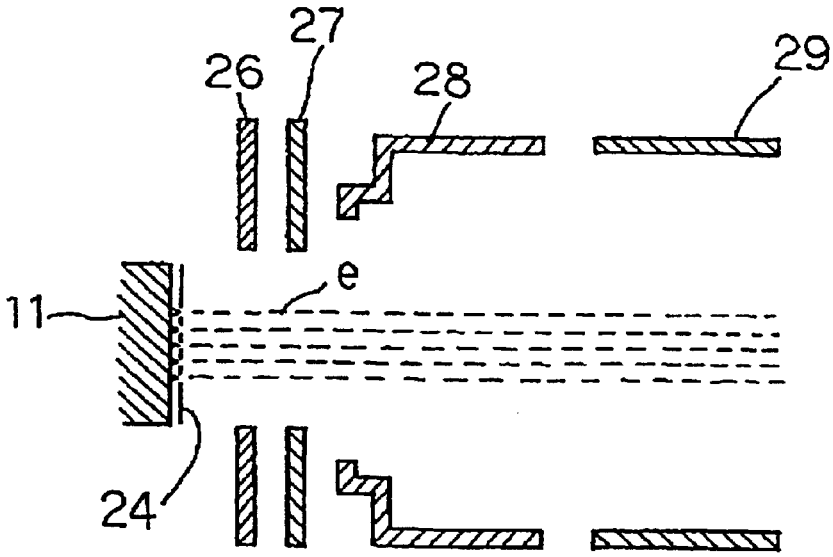
FIG. 19 is an expanded vertical section of electron gun 3 of CRT shown in FIG. 18.

In the CRT of the present embodiment, as shown in FIG. 18, electron beam current Ib (not shown) emitted from cold cathode 11 (not shown) provided in electron gun 3 is adjusted by changing the voltage applied on gate electrode 24 (not shown). As shown in FIG. 19, a first grid 26 serves as an accelerating electrode in other embodiments, and electron beam e is accelerated and focused by passing through first grid 26, second grid 27, third grid 28 and fourth grid 29 to be emitted in the direction of fluorescent screen 17, as shown in FIG. 18.

When the voltage of first grid 26 is expressed as Va, electron gun perveance $P\mu$ which is determined by the form of the electron gun and beam current Ib are settled so that they can satisfy expression 1.

Now, since Va is also settled to satisfy expression 1, generation of gas or positive ions caused by an electron beam which strike first grid electrode 26 is prevented, and hence deterioration of the cold cathode caused by positive ions can be prevented. Further, if beam current Ib increases up to a value which can no longer satisfy expression 1, the space charge effect in the vicinity of cathode 11 is intense causing electron beam e to diverge strongly. As a result, the electron beam spot diameter is increased deteriorating the resolution. Therefore, by making the electron tube device of the present invention operate within a range so that it can satisfy expression 1, deterioration of the resolution particularly at the point of strong luminance can be prevented.

While preferred embodiments of the present invention have been described using specific terms, such description is for illustrative purposes only, and it is to be understood that changes and variations may be made without departing from the spirit or scope of the following claims.

What is claimed is:

1. A method of impressing voltages on electrodes of an electron tube device mounted with a cold cathode, having an electron gun and a collector electrode, said electron gun including a cold cathode provided with an array of field emitters, a gate electrode, and an accelerating electrode, said method comprising the steps of:

impressing required voltages on said cold cathode, gate electrode, accelerating electrode and said collector electrode, respectively, and finally impressing the gate electrode voltage at the rise time of said device and first shutting off the gate electrode voltage at the fall time of said device.

2. A method of impressing voltages on electrodes of a traveling wave tube device mounted with a cold cathode, having an electron gun, a slow wave circuit and a collector electrode, said electron gun including a cold cathode provided with an array of field emitters, a gate electrode, a Wehnelt electrode, an accelerating electrode and an ion trap electrode, said method comprising the step of:

impressing required voltages on said cold cathode, gate electrode, accelerating electrode, Wehnelt electrode, ion trap electrode, slow wave circuit, and said collector electrode, respectively, and finally impressing the gate electrode voltage at the rise time of said device and first shutting off the gate electrode voltage at the fall time of said device.

3. An electron tube device mounted with a cold cathode comprising:

an electron gun including a cold cathode for emitting an electron beam from an array of field emitters, a gate electrode and an accelerating electrode;

a collector electrode;

a power supply unit for impressing required voltages on said cold cathode, gate electrode, accelerating electrode and collector electrode, respectively, and finally impressing the gate electrode voltage at the rise time of said device and first shutting off the gate electrode voltage at the fall time of said device.

4. A traveling wave tube device mounted with a cold cathode comprising:

an electron gun including a cold cathode for emitting an electron beam from an array of field emitters, a gate electrode, a Wehnelt electrode, an accelerating electrode and an ion trap electrode;

a slow wave circuit;

a collector electrode;

a power supply unit for impressing required voltages on said cold cathode, gate electrode, Wehnelt electrode, ion trap electrode, slow wave circuit and collector electrode, respectively, and finally impressing the gate electrode voltage at the rise time of said device and first shutting off the gate electrode voltage at the fall time of said device.

* * * * *